US011193666B2

(12) United States Patent
Lewis, Jr.

(10) Patent No.: US 11,193,666 B2
(45) Date of Patent: Dec. 7, 2021

(54) LINEAR LUMINAIRE

(71) Applicant: ABL IP Holding LLC, Atlanta, GA (US)

(72) Inventor: Paul W. Lewis, Jr., Grantville, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/895,392

(22) Filed: Jun. 8, 2020

(65) Prior Publication Data

US 2020/0386397 A1 Dec. 10, 2020

Related U.S. Application Data

(60) Provisional application No. 62/858,405, filed on Jun. 7, 2019.

(51) Int. Cl.

| | |
|---|---|
| ***F21V 31/00*** | (2006.01) |
| ***F21V 23/00*** | (2015.01) |
| ***F21V 17/16*** | (2006.01) |
| ***F21V 29/70*** | (2015.01) |
| ***F21S 4/28*** | (2016.01) |
| ***F21K 9/275*** | (2016.01) |
| *F21Y 115/10* | (2016.01) |
| *F21K 9/272* | (2016.01) |

(52) U.S. Cl.

CPC ..... *F21V 31/005* (2013.01); *F21K 9/275* (2016.08); *F21S 4/28* (2016.01); *F21V 17/16* (2013.01); *F21V 23/003* (2013.01); *F21V 29/70* (2015.01); *F21K 9/272* (2016.08); *F21Y 2115/10* (2016.08)

(58) Field of Classification Search

CPC .. F21K 9/272; F21K 9/275; F21S 4/28; F21V 17/16; F21V 31/005; F21Y 2103/00; F21Y 2103/10; F21Y 2115/10

See application file for complete search history.

(56) References Cited

U.S. PATENT DOCUMENTS

| | | | | |
|---|---|---|---|---|
| 9,976,735 | B2 | 5/2018 | Honda et al. | |
| D865,258 | S | 10/2019 | Honda et al. | |
| 2007/0223218 | A1* | 9/2007 | You | F21V 31/005 362/231 |
| 2013/0170209 | A1* | 7/2013 | Lee | F21V 33/006 362/249.01 |
| 2016/0219729 | A1 | 7/2016 | Omari et al. | |
| 2016/0305643 | A1 | 10/2016 | Duckworth et al. | |
| 2016/0327252 | A1* | 11/2016 | Ray | F21S 9/022 |
| 2018/0163943 | A1* | 6/2018 | Lu | F21S 45/50 |
| 2019/0338924 | A1* | 11/2019 | Vang | F21V 7/005 |

FOREIGN PATENT DOCUMENTS

| | | | | |
|---|---|---|---|---|
| DE | 102010013649 | A1 * | 9/2011 | F21V 21/30 |

* cited by examiner

*Primary Examiner* — Keith G. Delahoussaye

(74) *Attorney, Agent, or Firm* — Kilpatrick Townsend & Stockton LLP

(57) ABSTRACT

A linear luminaire comprising a scalable driver channel. The driver channel may be monolithic, formed by extrusion and cut to a custom length. The driver channel may provide a sealed enclosure for light engines and other components of the linear luminaire. The sealed enclosure may further be defined by end caps coupled to ends of the driver channel and light modules and accessory modules coupled to the bottom of the driver channel.

17 Claims, 30 Drawing Sheets

LINEAR LUMINAIRE

This application claims the benefit of U.S. Provisional Patent Application No. 62/858,405, filed on Jun. 7, 2019, and entitled Linear Luminaire, the content of which is hereby incorporated by reference in its entirety.

FIELD OF THE INVENTION

The present technology relates to luminaires including housings that protect the internal components from water ingress, corrosion, and extreme environments, for both indoor and outdoor use.

BACKGROUND OF THE INVENTION

Linear luminaires are used to provide general lighting for visibility. Linear luminaires may be mounted in environments where the luminaires are exposed to weather or various artificial conditions produced by related machinery or equipment. The internal components must be protected from the elements to maintain functionality which may be done by permanently sealing the component of the luminaire together. However, it is also beneficial to be able to remove components for replacement or repair. Accordingly, there is a need for a linear luminaire that provides a sealed interior to protect the components from the elements while also allowing for easy removal and reattachment of the components.

SUMMARY OF THE INVENTION

The present technology is directed toward linear luminaires comprising a scalable driver channel. The driver channel many be monolithic and provide a sealed enclosure for light engines and other components. The sealed enclosure may further be defined by end caps coupled to ends of the driver channel and light modules and accessory modules coupled to the bottom of the driver channel.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION OF THE INVENTION

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. The subject matter of features of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
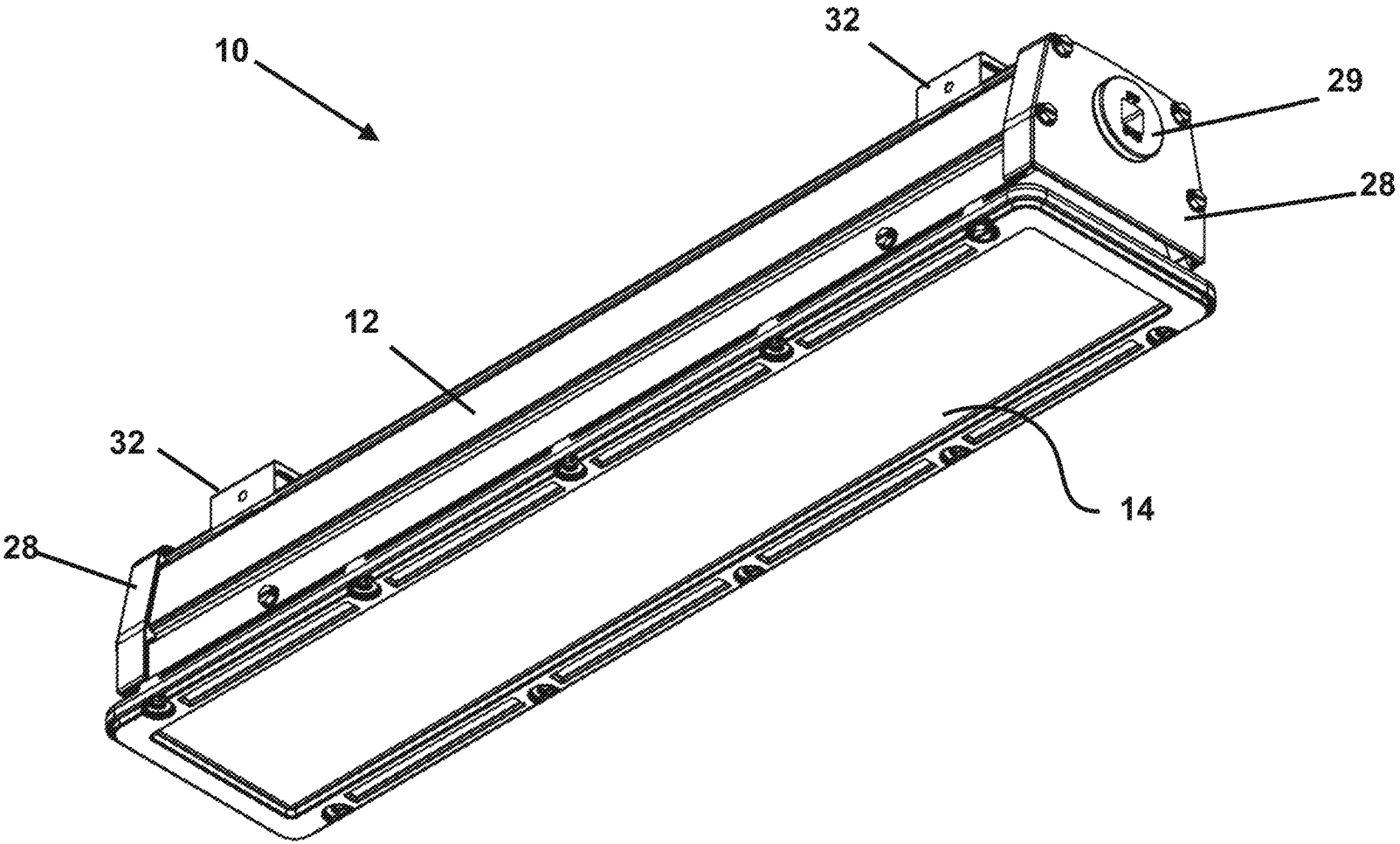
FIGS. 1 and 2 show perspective views of an embodiment of a linear luminaire according to the present invention.
Figure 2:
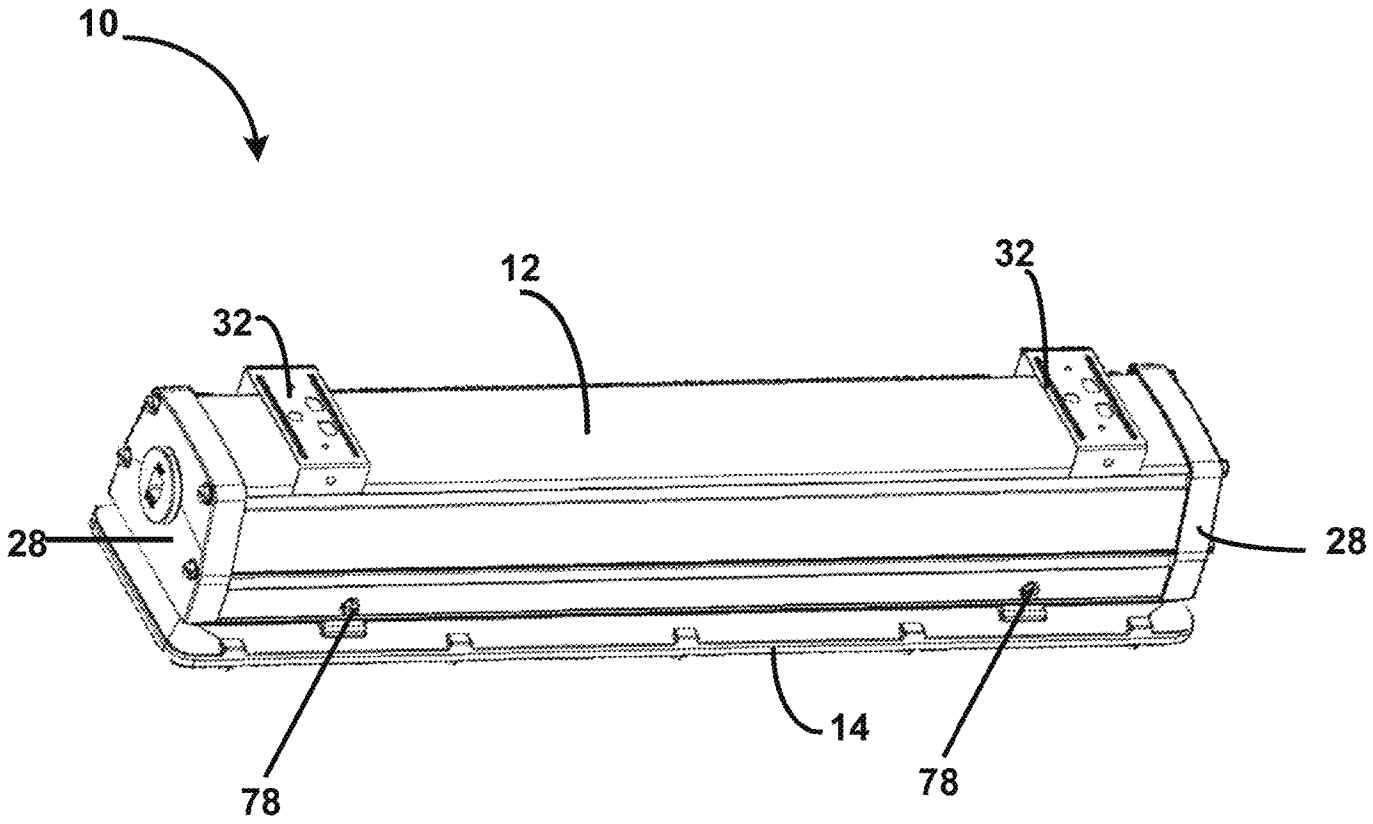

In embodiments, a linear luminaire comprises one or more light modules and/or accessory modules, a driver channel, and two end caps. For example, as shown in FIGS. 1 and 2, a linear luminaire 10 comprises a driver channel 12, a light module 14, and two ends caps 28. As shown, the light module 14 is coupled to the bottom side of the driver channel 12, and the end caps 28 are coupled to longitudinal ends of the driver channel 12. The coupling of the ends caps 28 to the driver channel 12 and the light module 14 to the driver channel 12 are sealed so that the interior space of the linear luminaire 10 is sealed from the elements. As further shown in FIGS. 1 and 2, two or mounting brackets 32 may be coupled to a top side of the driver channel 12 and used to attach the linear luminaire 10 to a structure, for example a building wall or ceiling, or a post.

Figure 3:
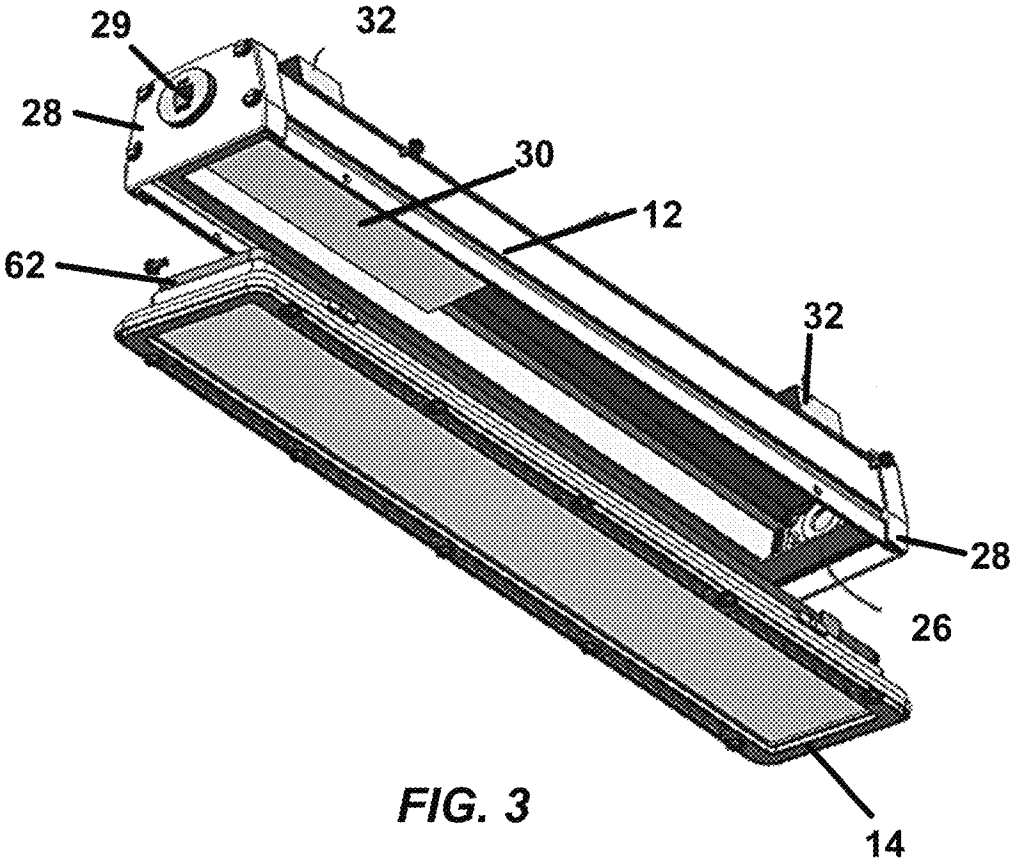
FIG. 3 shows an exploded view of the linear luminaire of FIG. 1.

FIG. 3 shows an exploded view of a linear luminaire 10. As shown, the bottom side of the driver channel 12 defines a sealing ledge 26 to which a gasket 62 of light modules 14 and/or accessory modules 16 contacts to form a sealed interface to prevent ingress of water into the interior from the bottom side of the driver channel 12. Further as shown in FIG. 3, screws 78 extend through holes 84 in a portion of a lateral side of the driver channel 12 and into receiving holes 83 of the light module 14, or an accessory module 16. In embodiments, the receiving holes 83 do not extend through the heat sink 50. The holes 84 and 83 in the driver channel 12 and the light/accessory modules do not penetrate the interior of the linear luminaire 10 and therefore do not provide a potential path for water to ingress to the interior. The light module 14 may additionally or alternatively be secured to the driver channel 12 with snap-fit between a lower edge of the driver channel 12 and a side of the heat sink 50 of the light module 14.

Further, as shown in FIG. 3, electrical power components (such as driver 30) may be housed within the sealed interior of the driver channel 12. Power may be supplied to the electrical power components through an aperture 79 in the end caps 28, so that the driver channel 12 does not have any holes into the interior except for the downward facing opening for the modules and the open lateral ends of the driver channel 12.

Figure 4A:
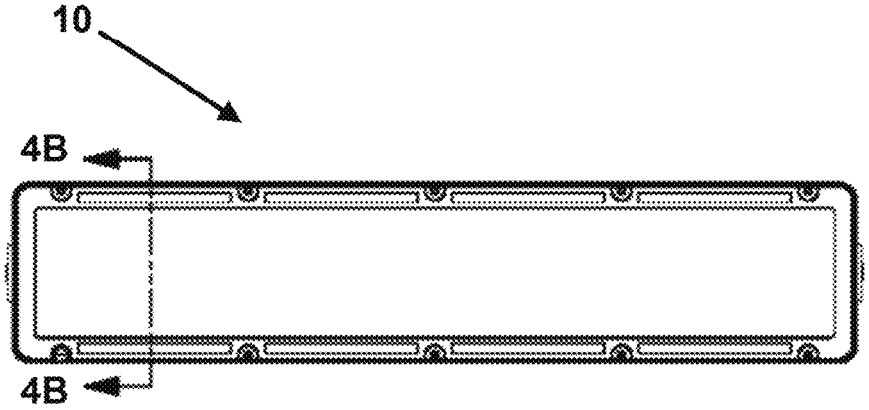
FIG. 4A shows a bottom view of the linear luminaire of FIG. 1.
Figure 4B:
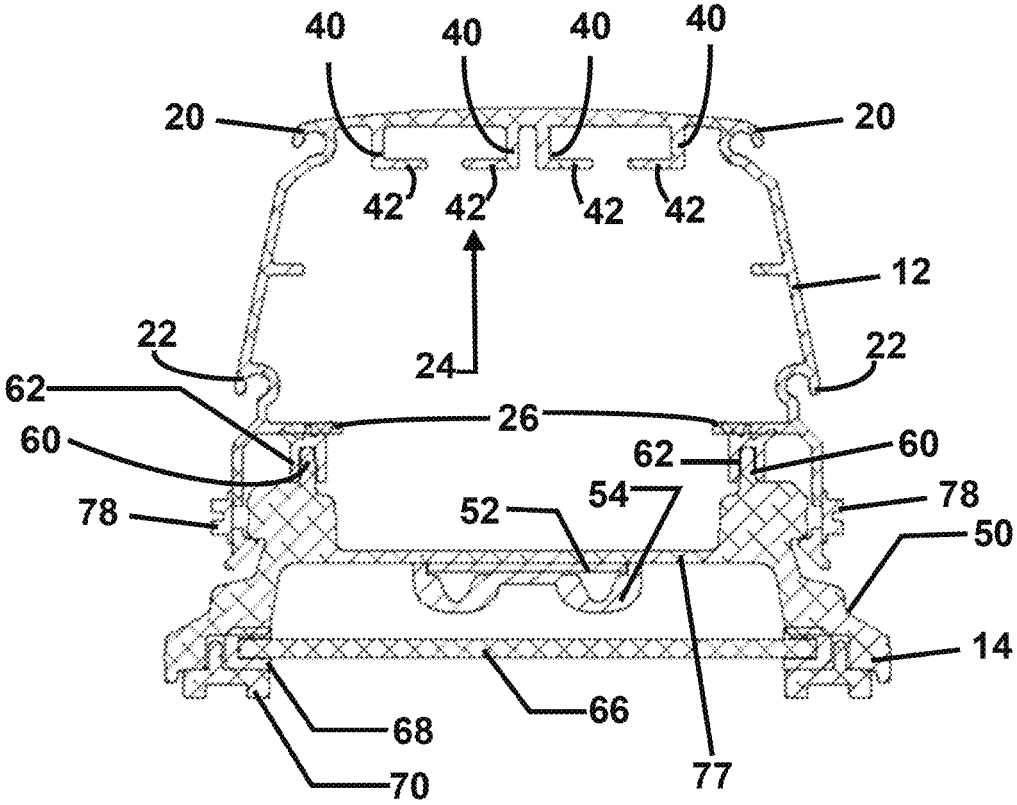
FIG. 4B shows a cross-sectional view indicated in FIG. 4A.

FIG. 4A is a bottom view of a linear luminaire 10 with an indication of the cross-sectional view of FIG. 4B. As shown in FIG. 4B, the light module 14 is received in a lower portion of the driver channel 12 between the sealing ledge 26 and a bottom edge of the driver channel 12. A heat sink 50 of the light module 14, as will be described in greater detail below, contacts an interior surface of the lower portion of the driver channel 12 in order to transfer heat from the light module 14 to be further dissipated into the environment by the driver channel 12.

As shown in FIG. 4B, the driver channel 12 defines electronic mounting rails 24 on an interior surface of the top side of the driver channel 12. Electronics may be attached to the electronics mounting rails 24 provided within the driver channel 12. Any electronics for powering and controlling the luminaire 10 may be housed within the driver channel 12, including, but not limited to, drivers 30, battery packs, transformers, etc. For the purposes of this disclosure, the term "transformer" encompasses a device that increases or decreases the voltage of AC power, and also encompasses a device that receives AC power and produces DC power. Note that while two electronics mounting rails 24 are illustrated, any number may be provided. Moreover, while the electronics mounting rails 24 are shown extending downwardly from the top of the inner surface of the top side of the driver channel 12, electronic mounting rails may additionally or alternatively be provided in other locations within the driver channel 12.

Driver Channel

The driver channel 12 provides the primary support structure of the linear luminaire. In embodiments, the driver channel 12 is formed as a linear body having a top side, a bottom side and two lateral sides. The interior of the driver channel 12 forms an enclosure and support structure for the electrical components of the luminaire 10 (e.g., driver, battery pack, transformer, etc.). In embodiments, the driver channel 12 is monolithic, and may be formed as an extrusion of metal. An extruded driver channel 12 may be extruded as a tube defining the top side, bottom side, and lateral sides of the driver channel 12. In embodiments, the driver channel 12 may alternatively be formed using a variety of different technologies, including, but not limited to, roll-forming, die-forming, stamping, casting, etc. In embodiments, after an initial formation step, a driver channel 12 may be further machined to define additional features on surfaces of the driver channel 12. The driver channel 12 may be formed or cut to any length.

The driver channel 12 may be formed of any material having suitable structural integrity and rigidity, including polymeric and metallic materials. In embodiments, the driver channel 12 is formed from materials also having suitable thermal management capabilities to conduct heat generated by electrical components attached thereto. Metallic materials, such as but not limited to steel and aluminum, may be particularly suitable.

In embodiments, the driver channel 12 is formed as a single-piece (monolithic), extruded aluminum housing that is cut into a desired length to accommodate one or more light modules 14 and/or other luminaire accessory modules 16. While the driver channel 12 may be cut into any length to accommodate any number of light engines/accessories, driver channel lengths of 2 foot increments (2 feet, 4 feet, etc.) may be particularly suitable for many applications.

The driver channel 12 includes features facilitating attachment of mounting brackets 32, end caps 28, lighting modules 14 and accessory modules 16 to the driver channel 12. In embodiments, including monolithic extruded embodiments, the features for facilitating attachment of components to the driver channel 12 extend along the entire length of the driver channel 12. The features may be formed integrally with the other components of the driver channel 12. In embodiments, for example as shown in FIG. 4B, the outer surface of the driver channel 12 is relatively smooth and shaped to promote water run-off or shedding in compliance with National Sanitation Foundation (NSF) requirements for light fixtures used in the food processing industry. Further, as shown, features including channel/grooves, are oriented in the same directions so that when one channel/groove is oriented in a direction where water will not pool in the channel/groove, water will not pool in the channels/grooves defined by the other features.

In embodiments, outer surfaces of the lateral sides of the driver channel 12 may include upper mounting rails 20 defining channels opening downwardly and outwardly when the linear luminaire is oriented with the light module 14 facing down. The upper mounting rails 20 may be used for attaching the mounting bracket 32 to the driver channel 12. The mounting bracket 32 may clip to the driver channel 12 without the need for fasteners. Not using a fastener to secure the mounting bracket 32 to the driver channel 12 is beneficial in allowing tool-less attachment and also not creating a potential path for water ingress through a hole into the interior which the fastener extends through. The channel formed by the upper mounting rails 20 may further receive screws in a longitudinal direction for securing the end caps 28 to the driver channel 12.

In embodiments, outer surfaces of the lateral sides of the driver channel 12 may include lower mounting rails 22 defining channels opening downwardly and outward when the linear luminaire is oriented with the light module facing down. The lower mounting rails 22 may be used for attaching mounting brackets 32. Additionally, the channel formed by the lower mounting rails 22 may further receive screws in a longitudinal direction for securing the end caps 28 to the driver channel 12.

As shown in FIG. 4B, the interior surface of the top side of the driver channel 12 includes electronic mounting rails 24 including first walls 40 extending away from the inner surface of the upper side of the driver channel 12 and second walls 42 extending perpendicularly to the first walls 40 to form an L-shaped electronic mounting rail 24. As shown, the driver channel 12 includes two pairs of opposing L-shaped electronic mounting rails 24 defining two rectangular channels providing surfaces against which the electronics can abut and be attached. In this way, screws or other types of fasteners for securing the electronics to the driver channel 12 do not pierce through to the exterior surfaces of driver channel 12 thus maintaining the water tight interior. Further, the electronic mounting rails 24 provide a direct thermal path from the electronics to the driver channel 12 for dissipation of heat generated by the electronics.

Figure 5:
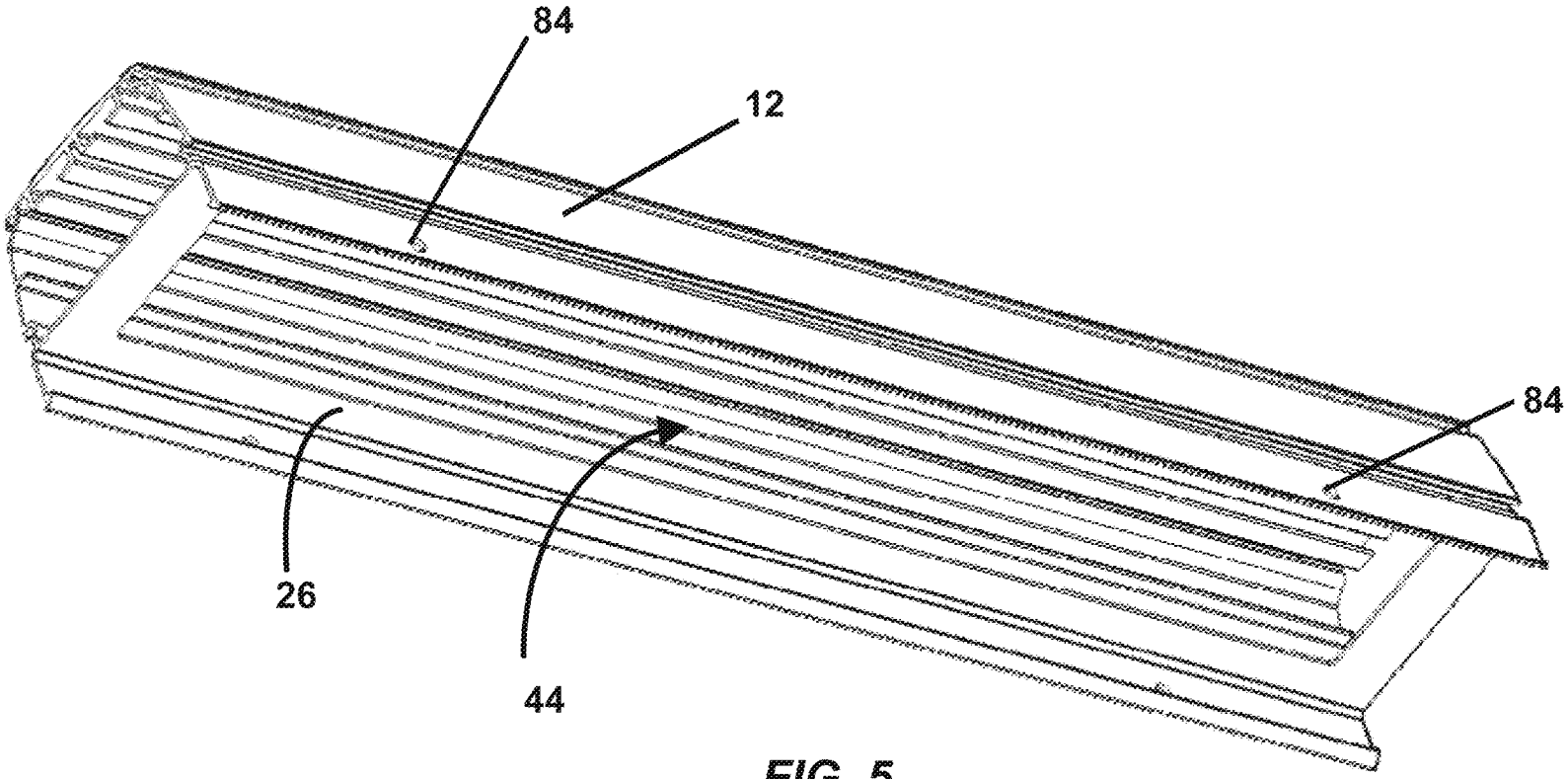
FIGS. 5 and 6 show views of an embodiment of a driver channel according to the present invention.
Figure 6:
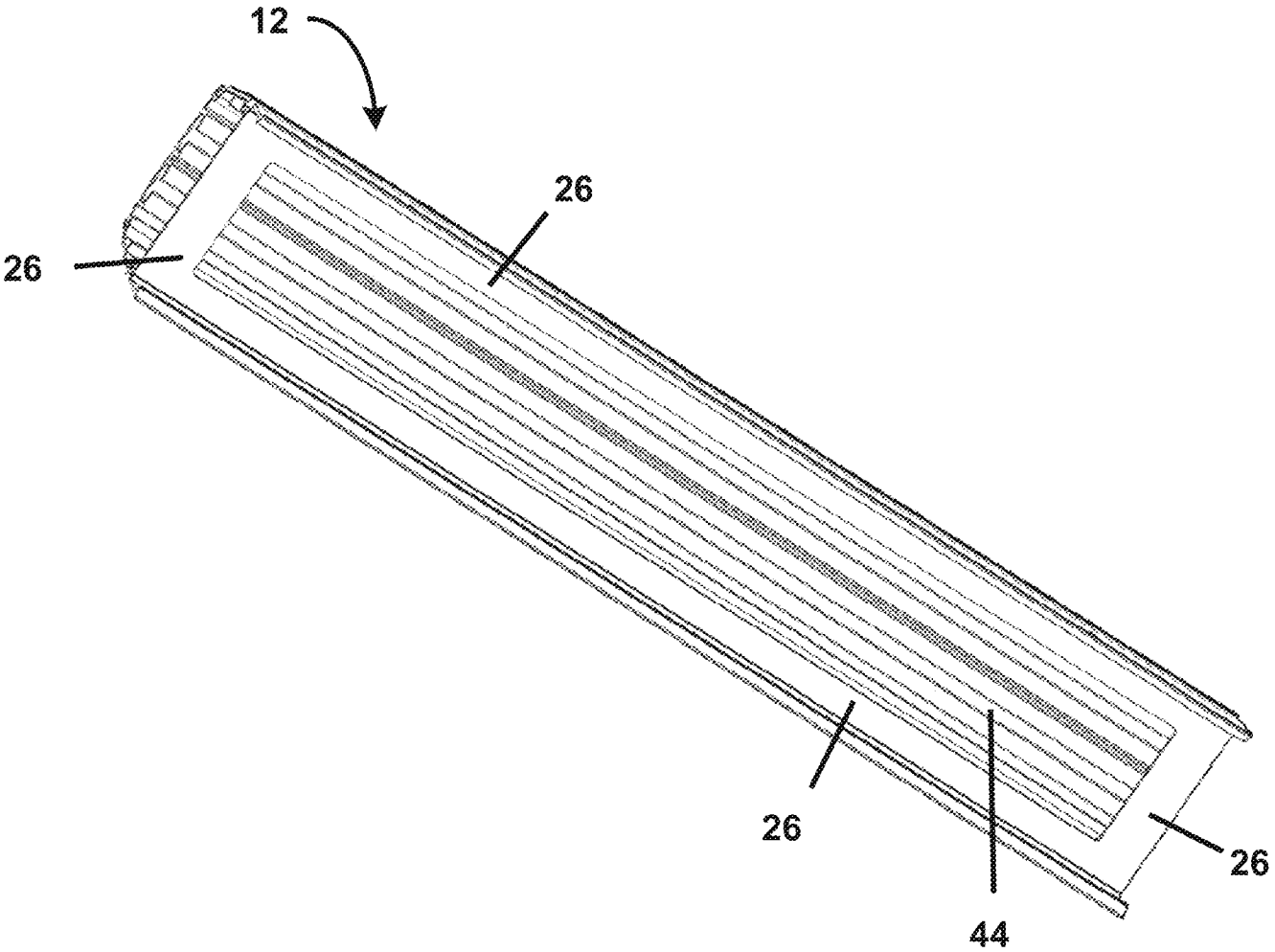
Figure 20:
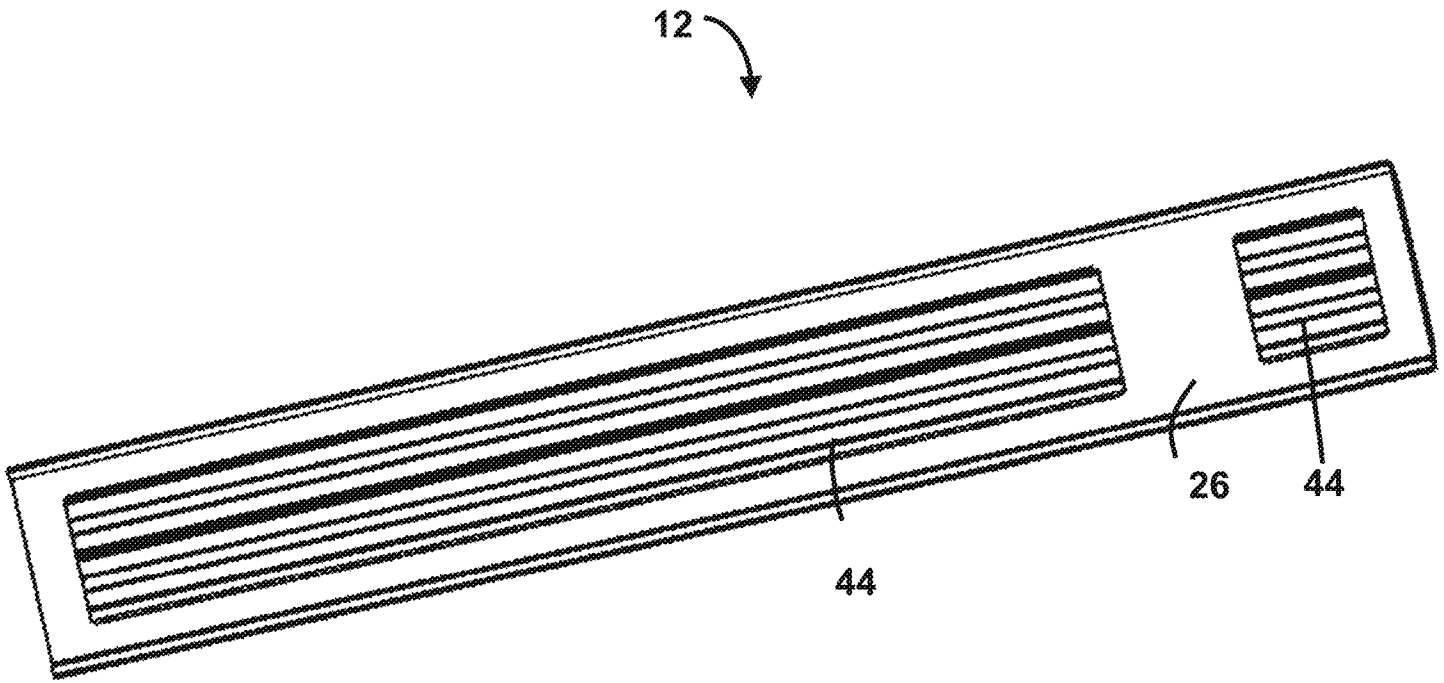
FIGS. 20 and 21 show views of an embodiment of a driver channel with two openings according to the present invention.
Figure 21:
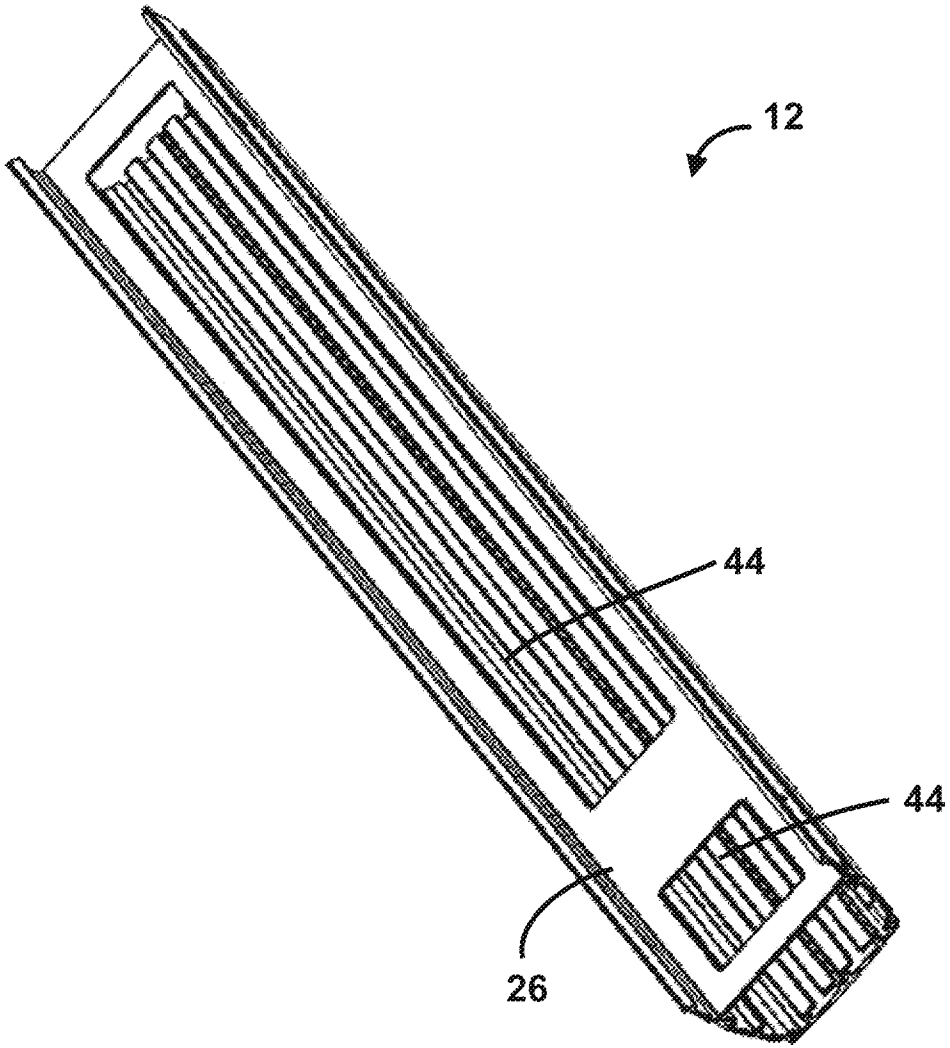

As shown in FIG. 5, the bottom side of the driver channel 12 defines an opening 44. The opening 44 is surrounded by the sealing ledge 26. In embodiments, the driver channel 12 may include a plurality of openings 44. One opening 44 may be provided for each light module 14 and accessory module 16. In embodiments, the openings 44 may be formed after the driver channel 12 is monolithically formed, for example extruded. For example, prior to forming the opening 44, the bottom side of the driver channel 12 may include a continuous surface between the lateral sides of the driver channel 12. One or more portions of the continuous surface may be removed via a cutting process, for example plasma cutting, laser cutting, punching, water-jet, sawing, or milling, to form the openings 44 and the sealing ledge 26 surrounding the openings 44. The opening 44 may be formed so that a portion of the sealing ledge 26 spans between the lateral sides of the driver channel 12 to form a rectangular border around the opening 44, as shown for example in FIG. 6. FIGS. 20 and 21 show an example of an embodiment including a plurality of openings 44, wherein the sealing ledge 26 includes portions spanning between the lateral sides of the driver channel 12 between two openings 44. Further as shown in FIG. 20, the sealing ledge 26 may include portions with different widths. Wider portions of the sealing ledge 26 may accommodate gaskets 62 of two adjacent light modules 14 or accessory modules 16. In embodiments, the openings 44 are rectangular and are sized and shaped to correspond to gaskets of modules 14 and 16 received against the sealing ledges 26 surrounding the openings 44.

Light Modules

Figure 7:
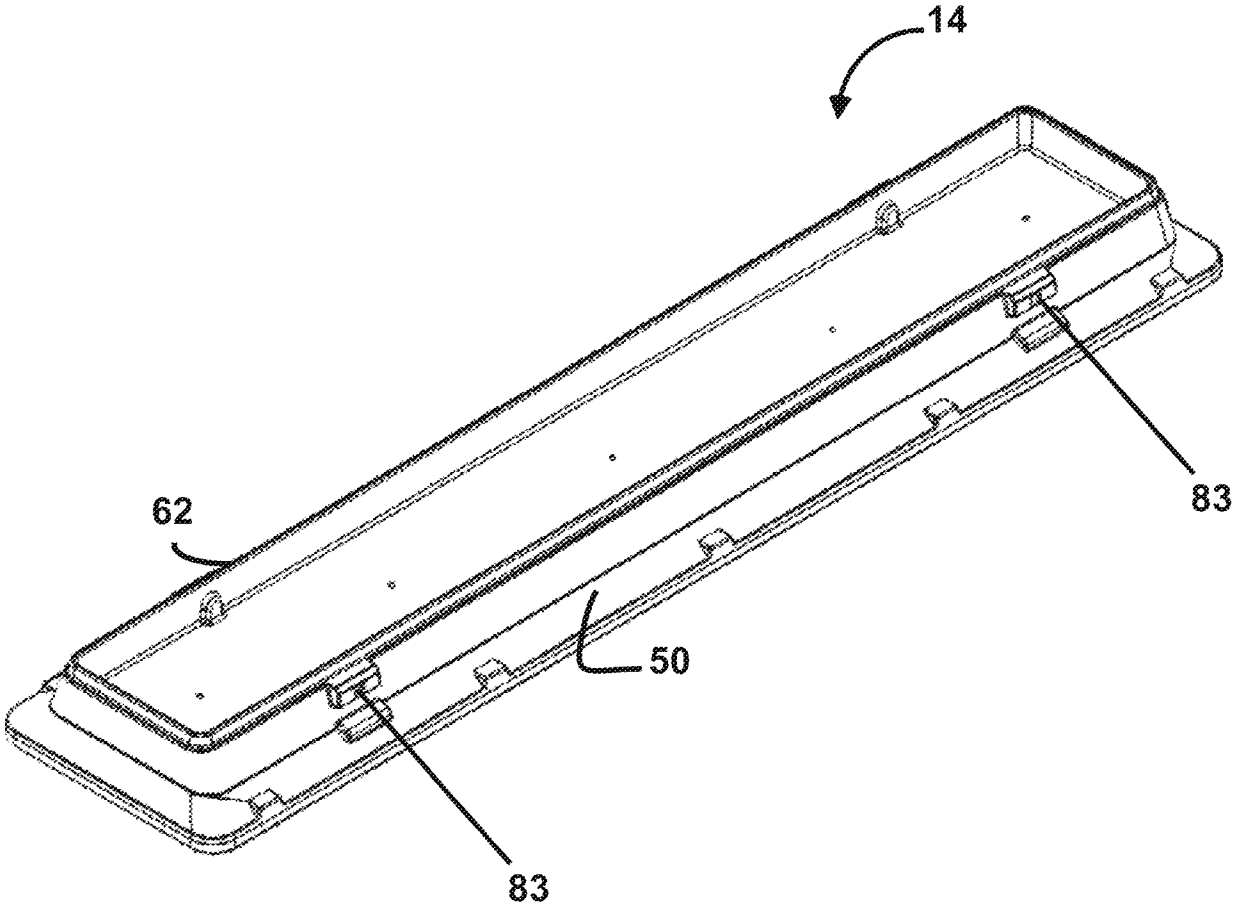
FIGS. 7, 8, 9, and 10 show views of an embodiment of a light module according to the present invention.
Figure 8:
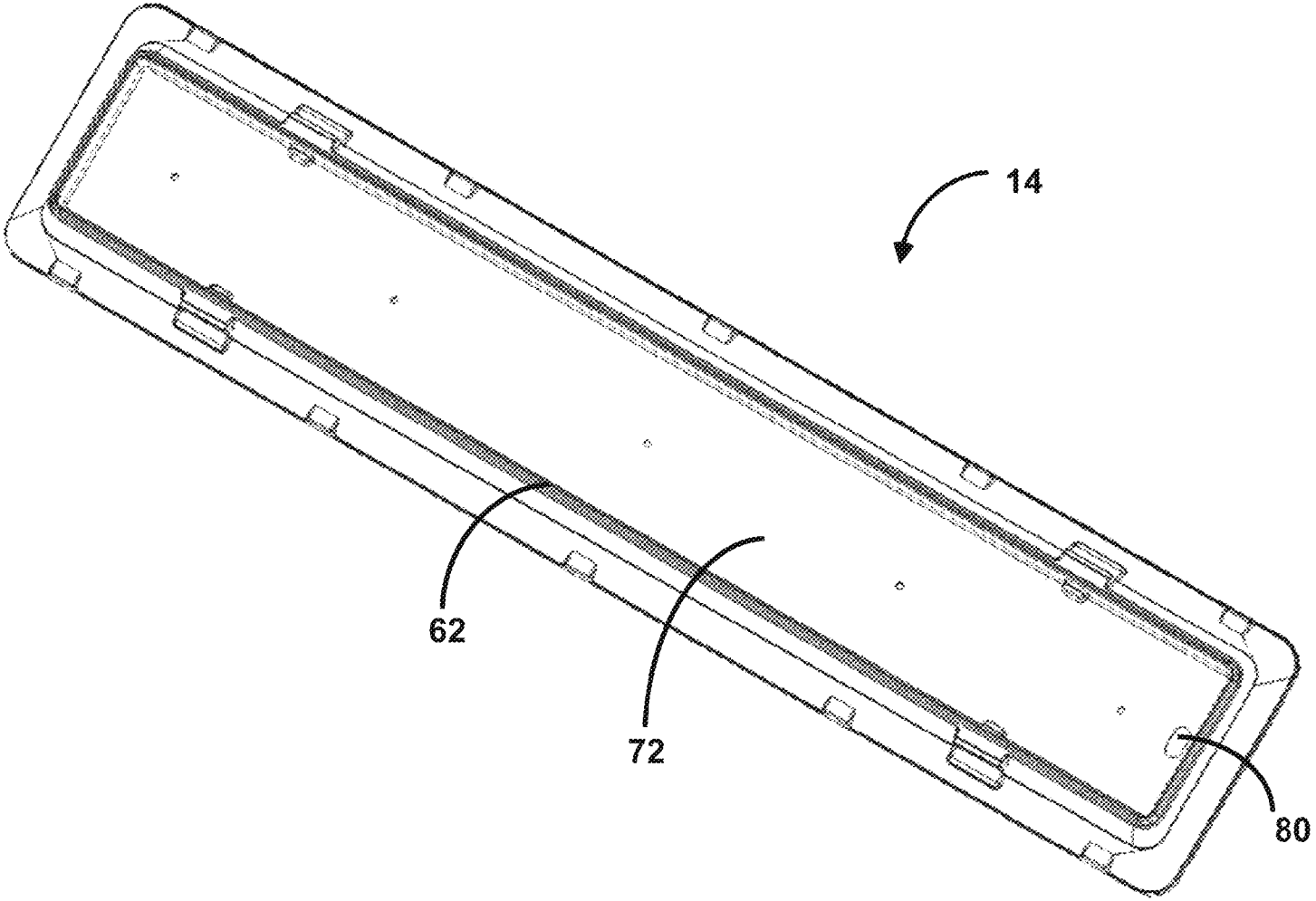
Figure 9:
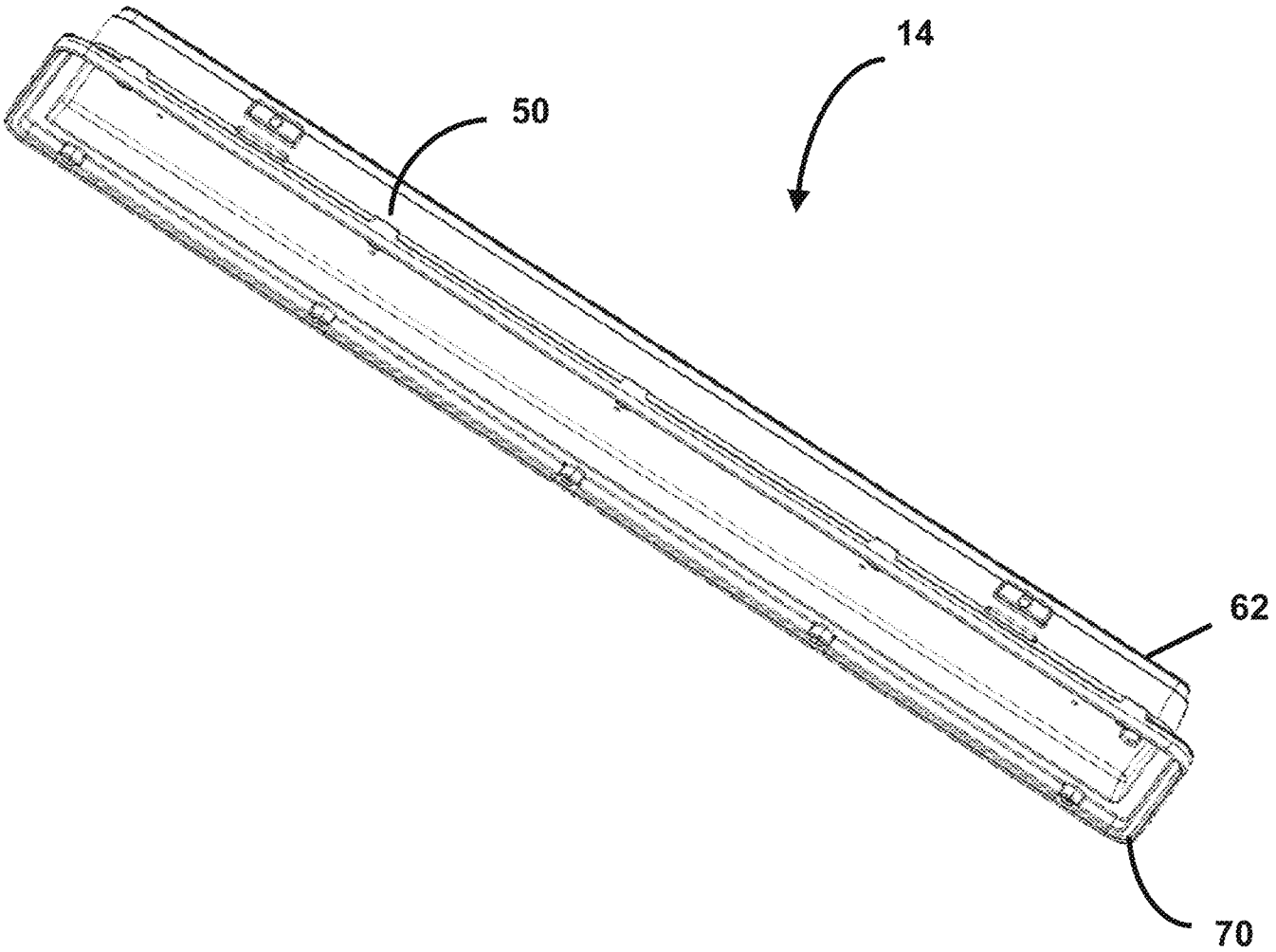

As shown in FIG. 4B, light modules 14 are received within the lower portion of the driver channel 12 to seal the interior of the driver channel 12 from the bottom. FIG. 7 shows a perspective view of a light module 14. As shown, in embodiments, light modules 14 include a heat sink 50, which provides enclosure and/or support for other elements of the light module 14. The heat sink 50 may be sealed against a driver channel 12 with a gasket 62, for example as shown in FIG. 4B. Gaskets 62 may be coupled to a rib 60, as shown in FIG. 4B, of the heat sink 50 and extend around a perimeter of an upper portion of the heat sink 50, as shown in FIG. 7. As shown in FIG. 4B, the heatsink may comprise a lower cavity and an upper cavity separated by a central wall 77.

The heat sink 50 may be made from any metallic or polymeric material having suitable rigidity and suitable thermal management properties to effectively dissipate heat generated by the light engines 52 attached to the heat sink 50. For example, in embodiments the heat sink 50 is formed from metal, such as aluminum or steel. In embodiments, the heat sink 50 is formed of extruded aluminum.

As shown in the cross-sectional view of FIG. 4B, the heat sink 50 houses a light engine 52 mounted to the underside of the central wall 77 of the heat sink 50. In embodiments, the light engines 52 include light emitting diodes ("LEDs") mounted on a printed circuit board ("PCB") and wired to the PCB. Any number of light engines 52 may be mounted on the heat sink 50. Each light engine 52 can have wiring for connecting to a driver 30, which can be shared between light engines 52 or each light engine 52 could have its own power supply. The LEDs may be single-die or multi-die LEDs, DC or AC, or can be organic light emitting diodes. White, color, or multicolor LEDs may be used. Moreover, the LEDs mounted on a PCB need not all be the same color; rather, mixtures of LEDs may be used. Furthermore, in embodiments no PCB is included, and LEDs are chip-on-board LEDs provided directly on the underside of the central wall 77 of the heat sink 50. The light engines 52 may be retained on the heat sink 50 in any of a variety of ways, including with screws that extend through the light engines 52 and engage the heat sink 50. As shown in FIG. 4B, an inner optic 54 may be, but need not be, provided over the light engines 52.

Figure 10:
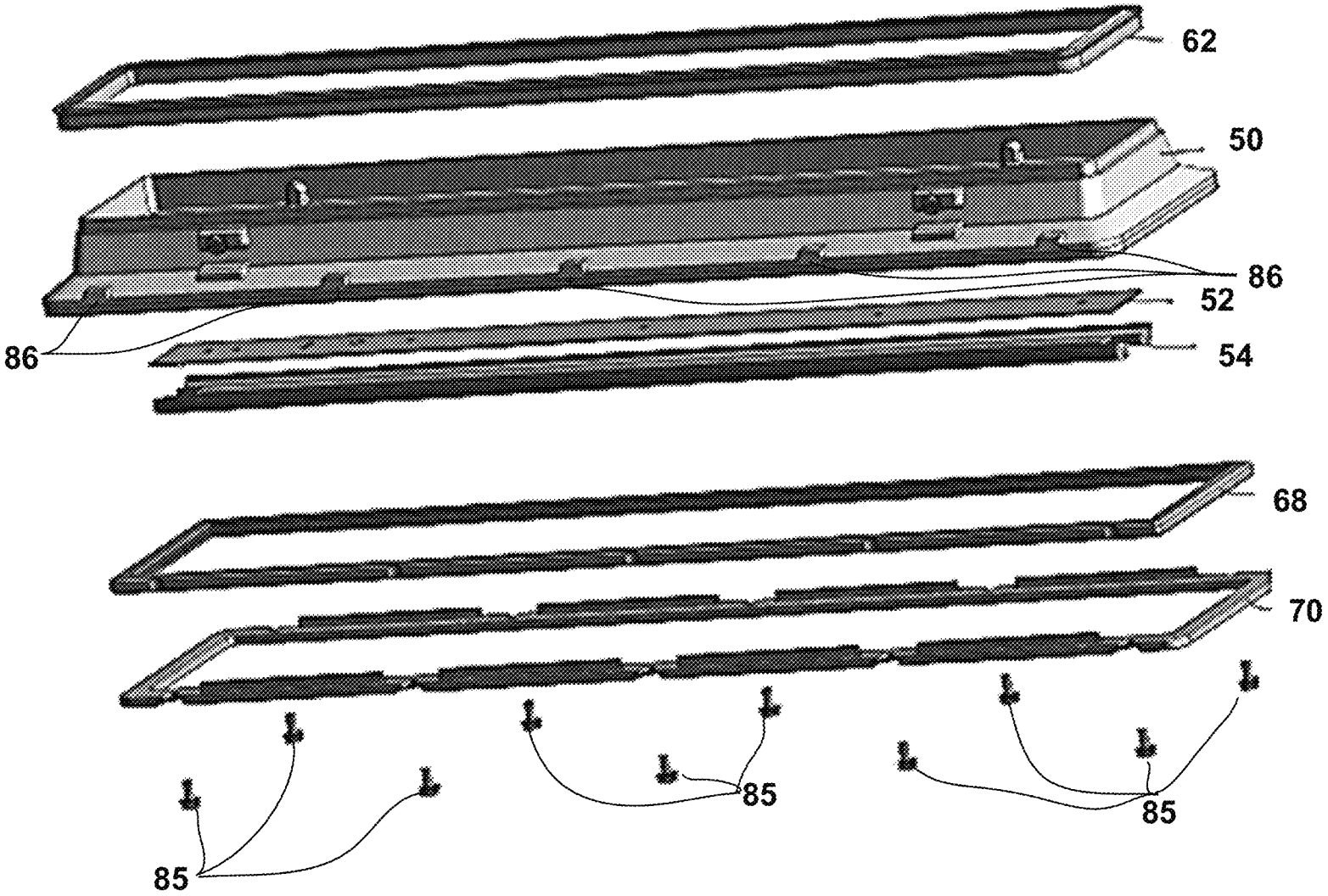
Figure 11:
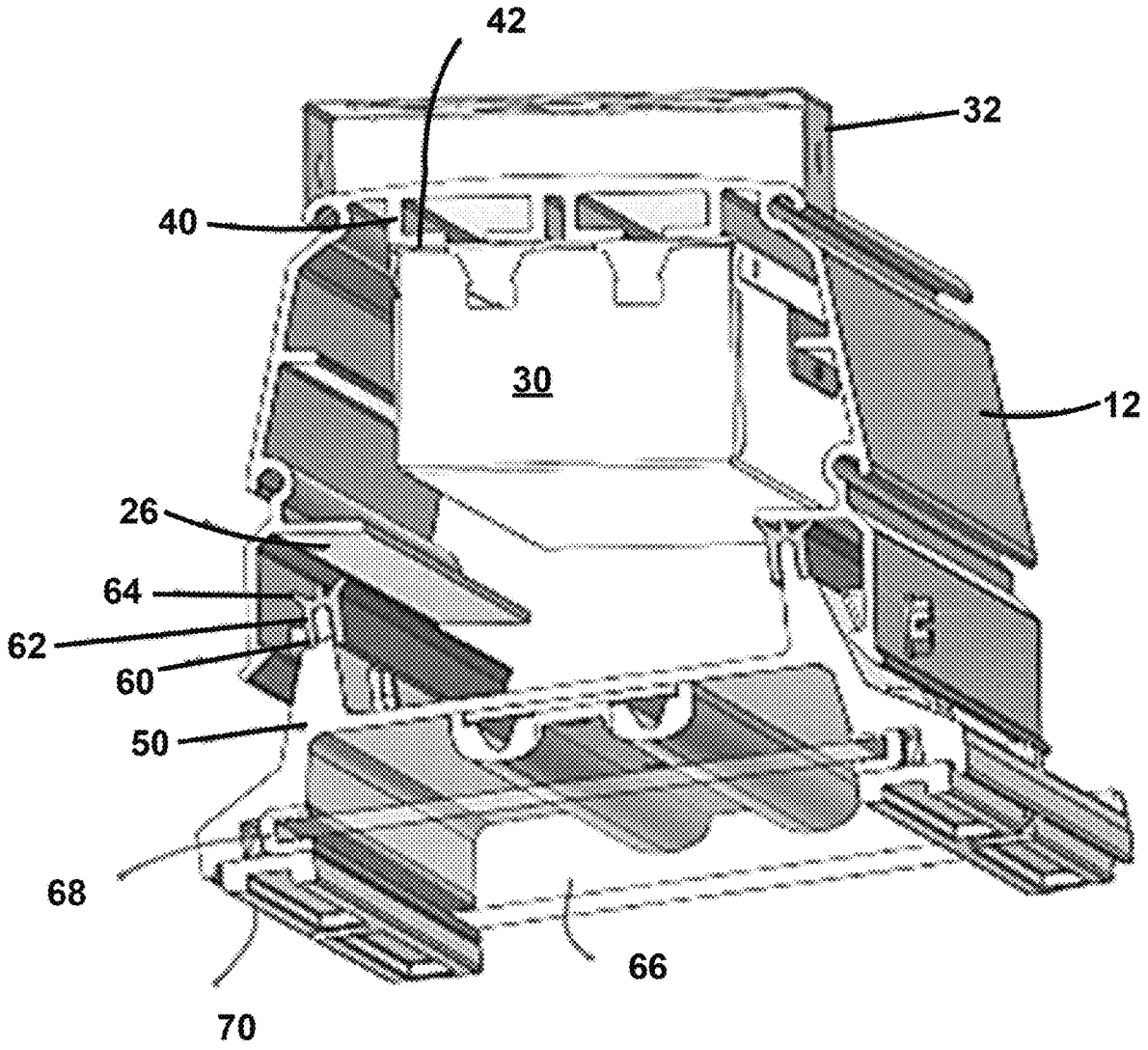
FIGS. 11, 12, 13, and 14 show cross-sectional views of an embodiment of a linear luminaire according to the present invention.
Figure 12:
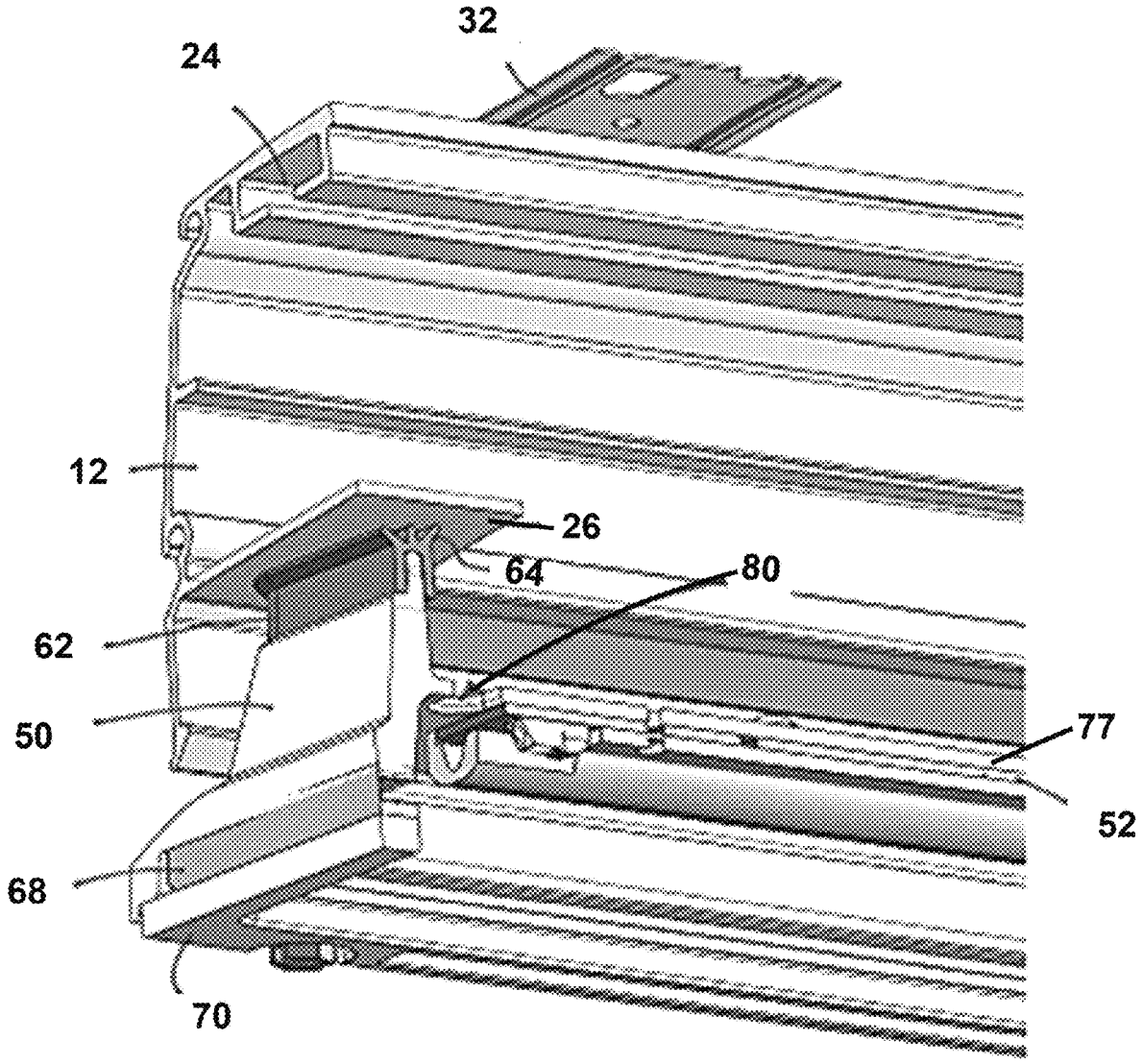
Figure 13:
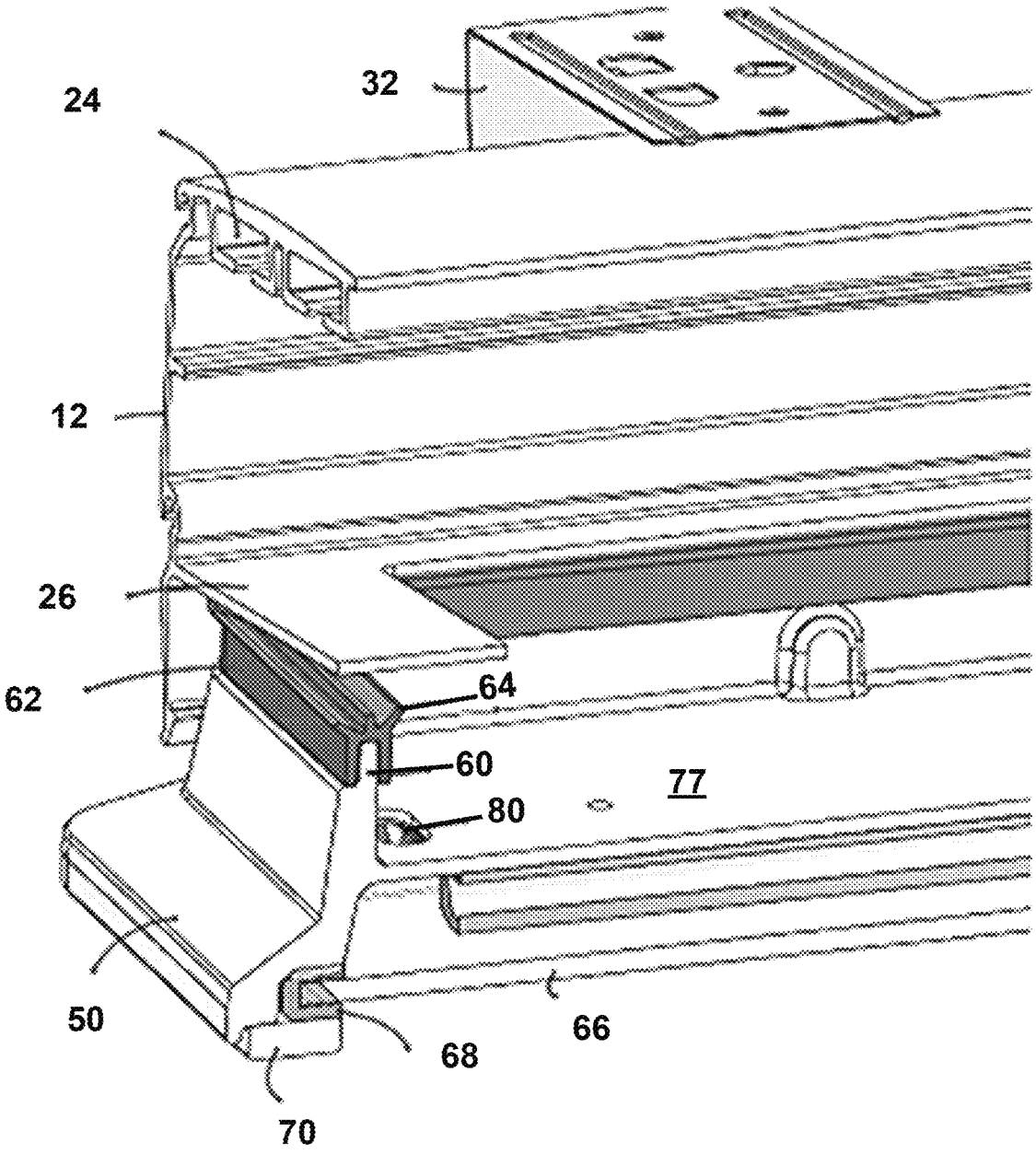

As shown in FIGS. 4B and 10, the heat sink 50 includes a rib 60 integrally formed with the heat sink 50 and extending around the upper perimeter of the heat sink 50. The one or more gaskets 62 seat over the rib 60. As shown in FIGS. 11-13, the gasket 62 comprises one or more fingers 64 configured to contact the sealing ledge 26 and form a plurality of redundant seals. In embodiments, the gasket 62 may be any shape and/or geometry to create a sealed interface between the light module 14 or accessory module 16 and the driver channel 12.

In embodiments, the heat sink 50 may include heat sink fins provided on one or more surfaces of the heat sink 50, such as, but not limited to, the exposed outer surface of the heat sink 50. Any number and/or arrangement of heat sink fins may be used. In embodiments, wiring between the light engine 52 and the electronics within the driver channel 12 are routed through an aperture 80 in the central wall 77 of the heat sink 50 and through the opening 44 defined in the driver channel 12. In embodiments, the wiring is potted within the apertures 80 to maintain a seal between the lower cavity of the heat sink 50 and the upper cavity, and therefore the interior of the driver channel 12.

The light module 14 may also include a lens 66, for example as shown in FIG. 4B, which serves both as an aesthetic cover and to functionally direct or diffuse light from the light engine 52. The lens 66 may be formed of glass or plastic (e.g., acrylic, polycarbonate, silicone, etc.), typically but not necessarily by molding. In embodiments, the lens 66 is configured with optical enhancements to achieve a desired light distribution and effect from the luminaire 10. The lens 66 may be of any type (diffuse, prismatic, etc.) that achieves the desired light emission from the luminaire 10, may have any geometry, and may be provided with any surface enhancements or no surface enhancements.

A lens gasket 68 is provided around the outer edge of the lens 66, for example as shown in FIGS. 4, 11, 12, and 13. In embodiments, the lens gasket 68 is provided around the entirety of the outer edge of the lens 66 in order to seal the lower cavity of the heat sink 50. As shown in FIG. 4B, the lens gasket 68 may include a receiving slot for receiving the edge of the lens 66 such that a portion of the lens gasket 68 extends along a portion of the upper and lower surface of the lens 66. The lens 66 is secured to the heat sink 50 via a lens retainer ring 70. As shown in FIG. 10, the lens retainer ring 70 is positioned so that the lens gasket 68 is clamped between the lens retainer ring 70 and the heat sink 50. The lens gasket 68 serves to seal the light module 14 and prevent the ingress into the light module 14 of water and other environmental elements that could detrimentally impact its operation and performance. Screws 85 extend through the lens retainer ring 70 and into the heat sink 50 to clamp the lens 66 against the heat sink 50. The screws 85 and corresponding holes 86 do not extend into the lower cavity of the heat sink 50, and therefore do not form a potential path of water ingress into the lower cavity of the heat sink 50 and therefore into the interior of the driver channel 12.

Figure 14:
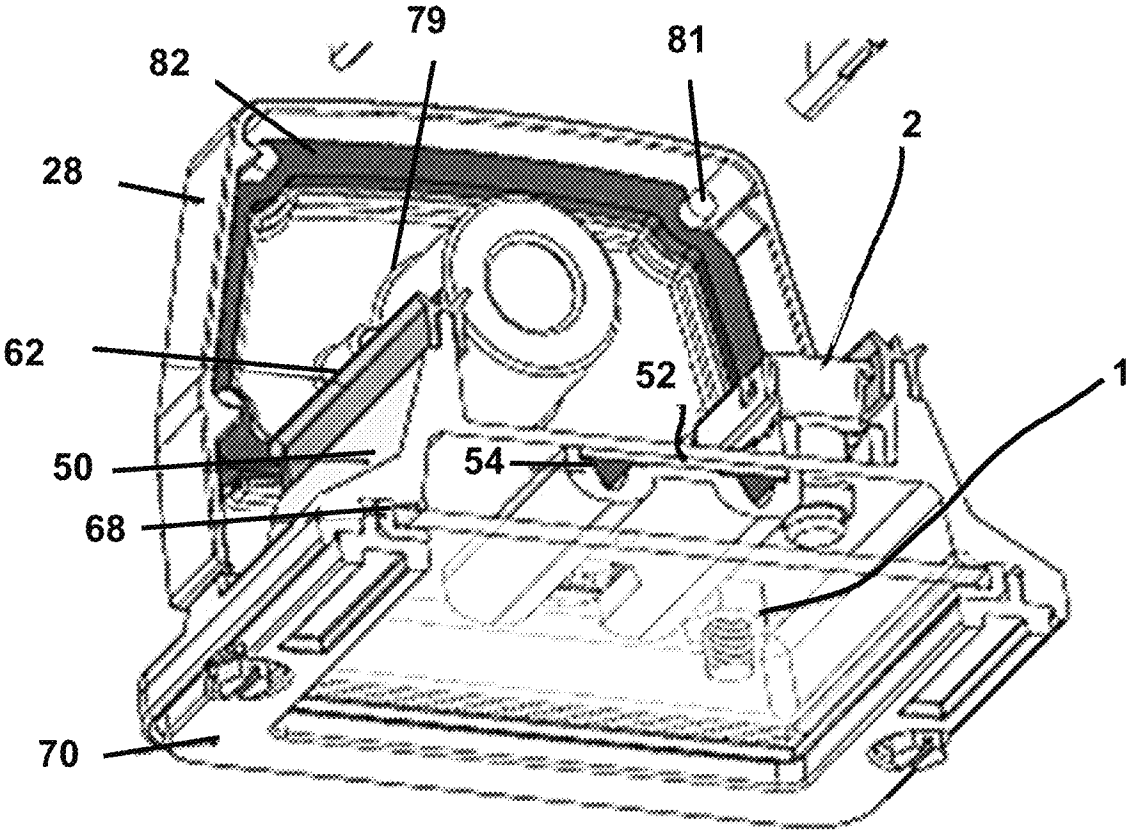
Figure 15:
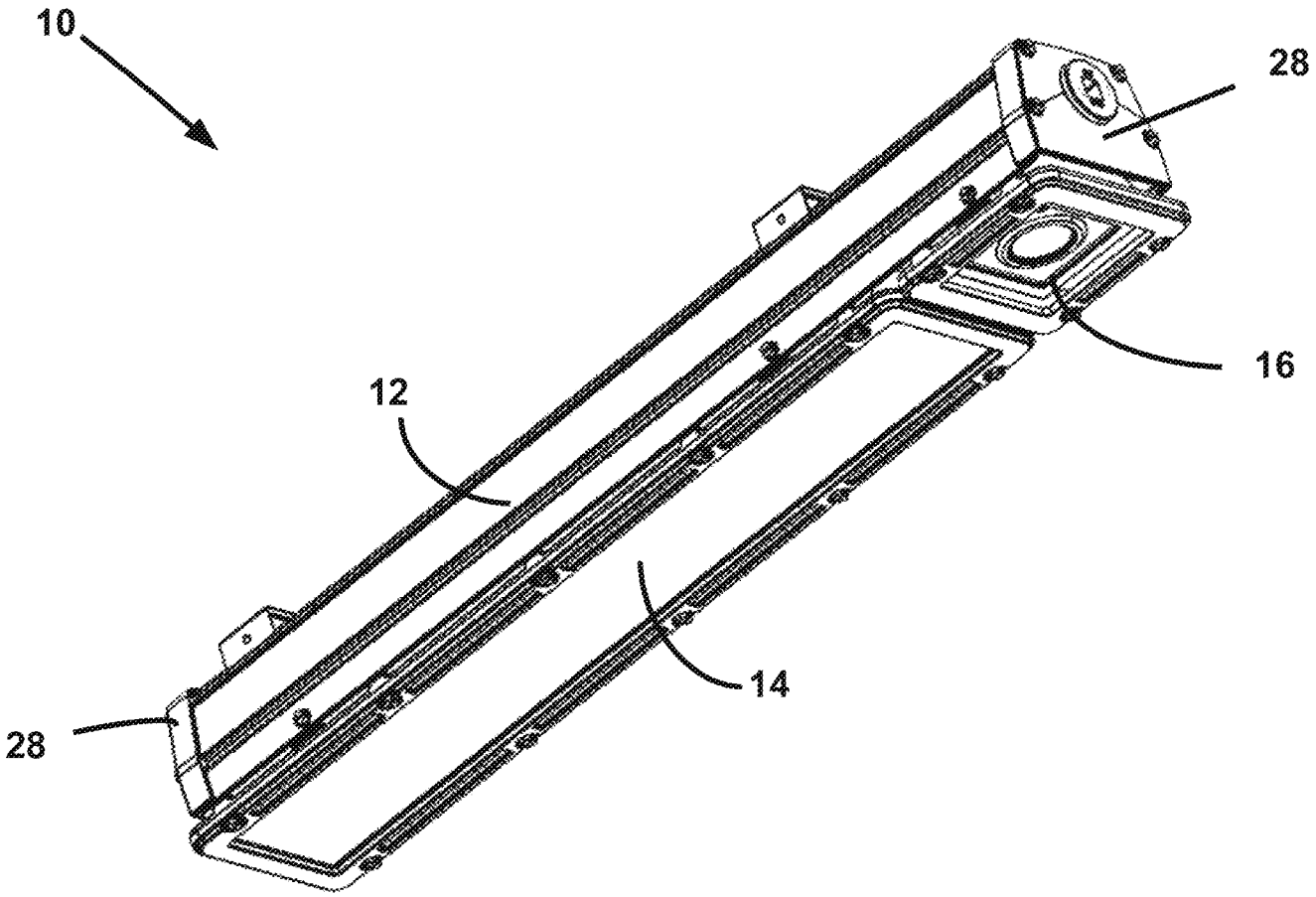
FIGS. 15, 16, 17, 18, and 19 show views of an embodiment of a linear luminaire including a light module and an accessory module according to the present invention.
Figure 16:
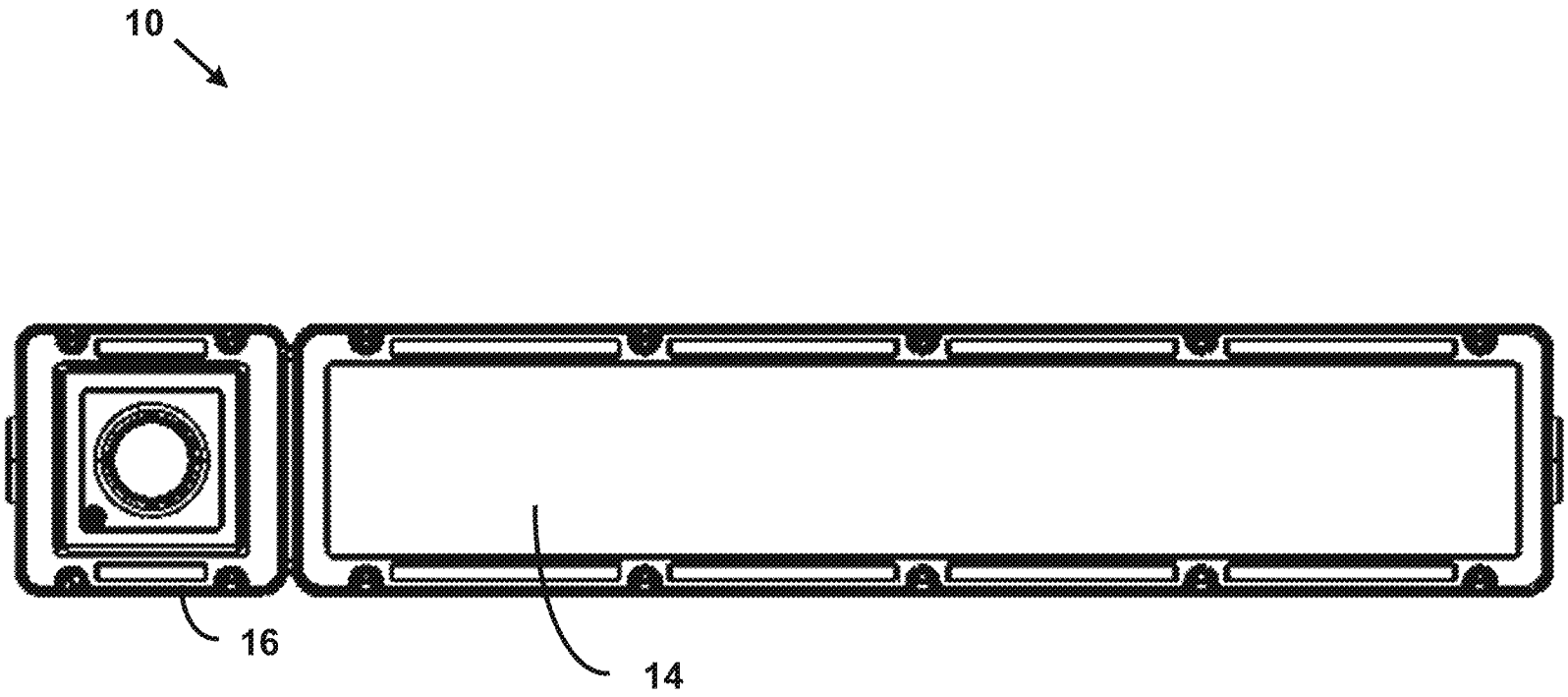
Figure 17:
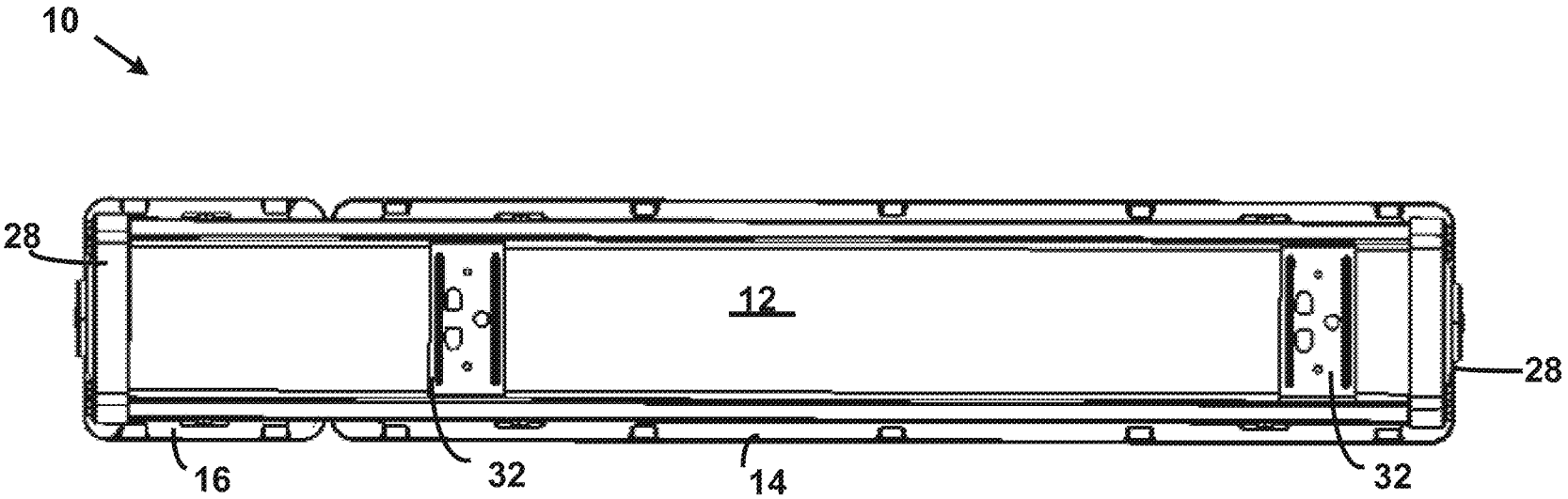
Figure 18:
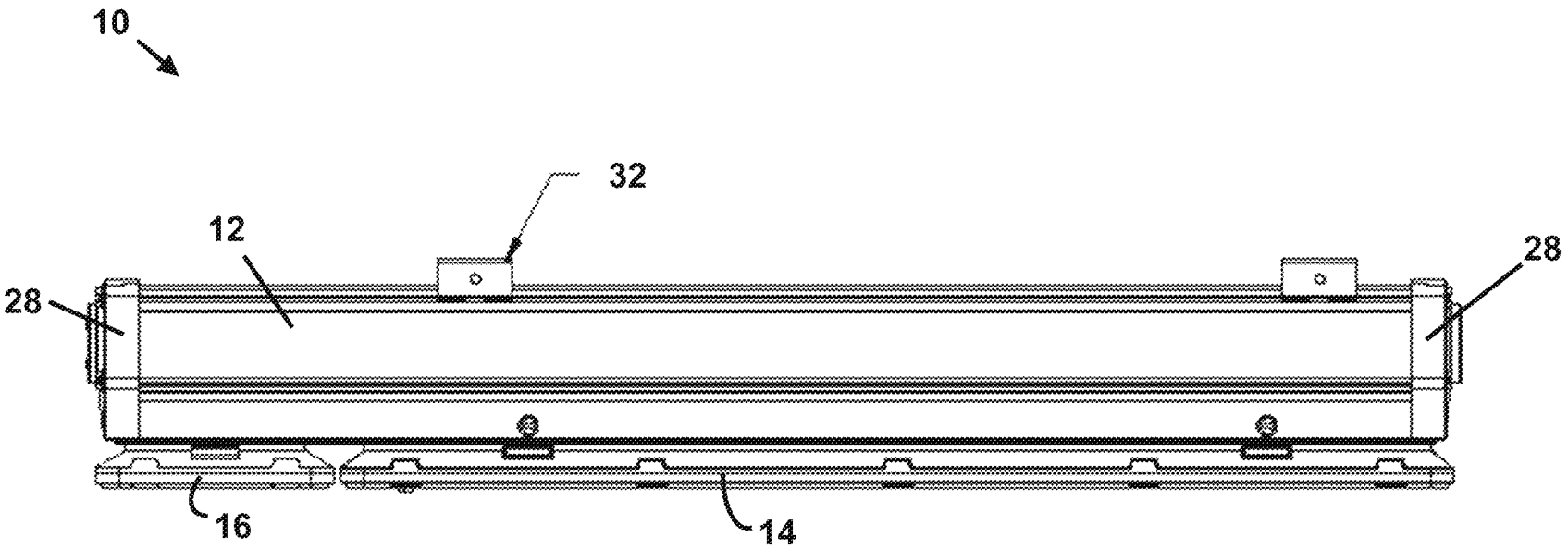
Figure 19:
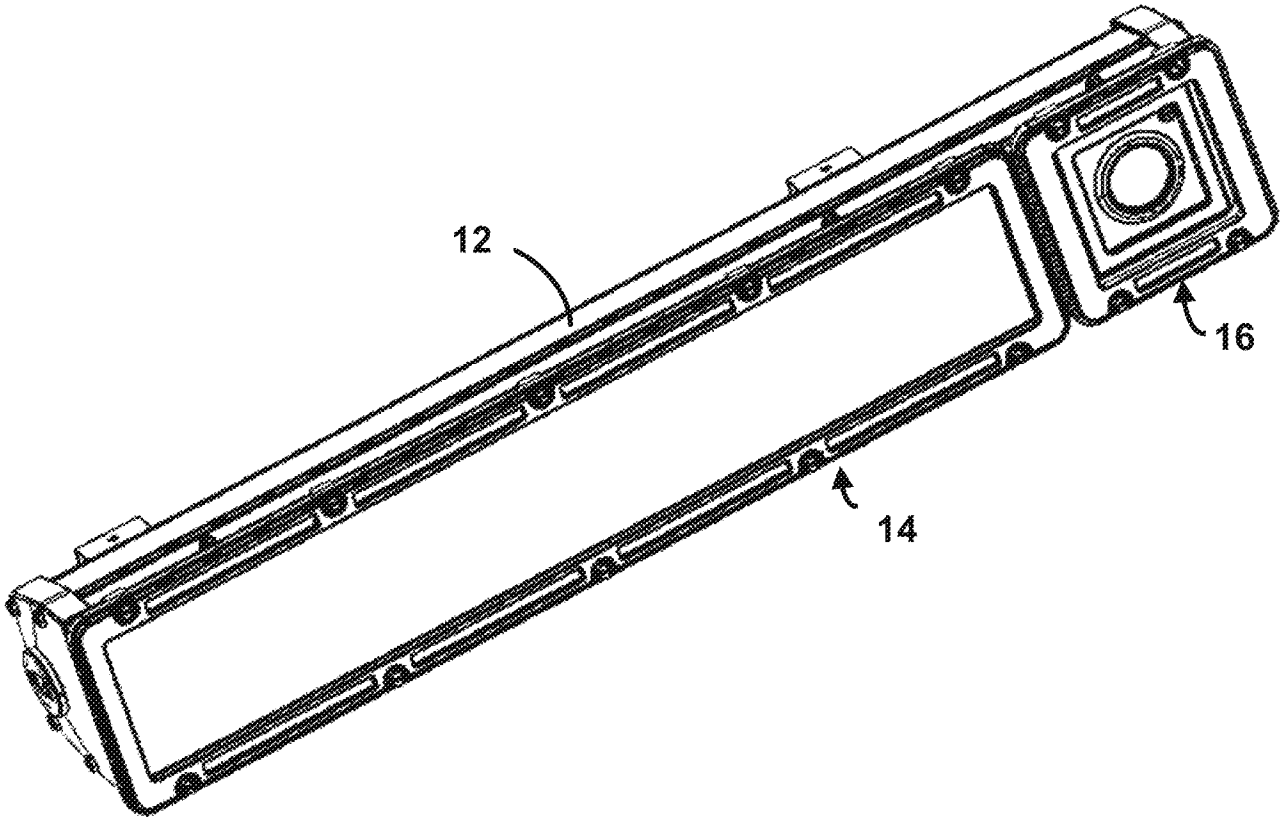

In embodiments, additional functionality may be imparted to the light engines 52, but such additional features are certainly not required. By way only of example, FIG. 14 illustrates an embodiment whereby a magnetic test strip 1 and indicator light 2 are provided on and sealed within the light module 14. A magnetic wand can be used from below to activate the test switch and throw the luminaire into test mode (i.e., main power to the luminaire is cut and the luminaire is run on battery power).

End Caps

End caps 28 are coupled to the longitudinal ends of the driver channel 12 in order to seal the open longitudinal ends of the driver channel 12 to define the sealed interior. FIG. 14 shows an end cap 28 and a portion of a light module 14, with the driver channel 12 omitted for clarity. As shown, the pair of upper mounting rails 20 and the pair of lower mounting rails 22 receive fasteners 81 for attaching the end caps 28 to the opposing longitudinal ends of the driver channel 12. More specifically, the fasteners 81 extend through the end caps 28 and engage the mounting rails 20, 22 to secure the end caps 28 to the driver channel 12. The fasteners 81 and the mounting rails 20, 22 remain outside of the interior of the driver channel 12 and therefore no potential paths of water ingress are formed with this coupled. A gasket 82 may be provided between the end cap 28 and the longitudinal end face of the driver channel 12. The gasket 82 may be compressed to form a seal when the fasteners 81 are tightened to secure the end cap 28 to the driver channel 12. The gasket 82 may be shaped and size to correspond to the profile of the driver channel 12.

The end caps 28 may include an aperture 79 for receiving input power lines which are connected to the electronic components (e.g. drivers 30) housed within the driver channel 12 for powering and controlling the luminaire 10. For example, drivers 30 may convert line voltage, for example 110 volt or 220 volt alternating current (AC) power, to a lower voltage direct current (DC) power suitable for driving LEDs. Plugs 29 may be used to seal off the unused end cap apertures 79.

Accessory Modules

Figure 28:
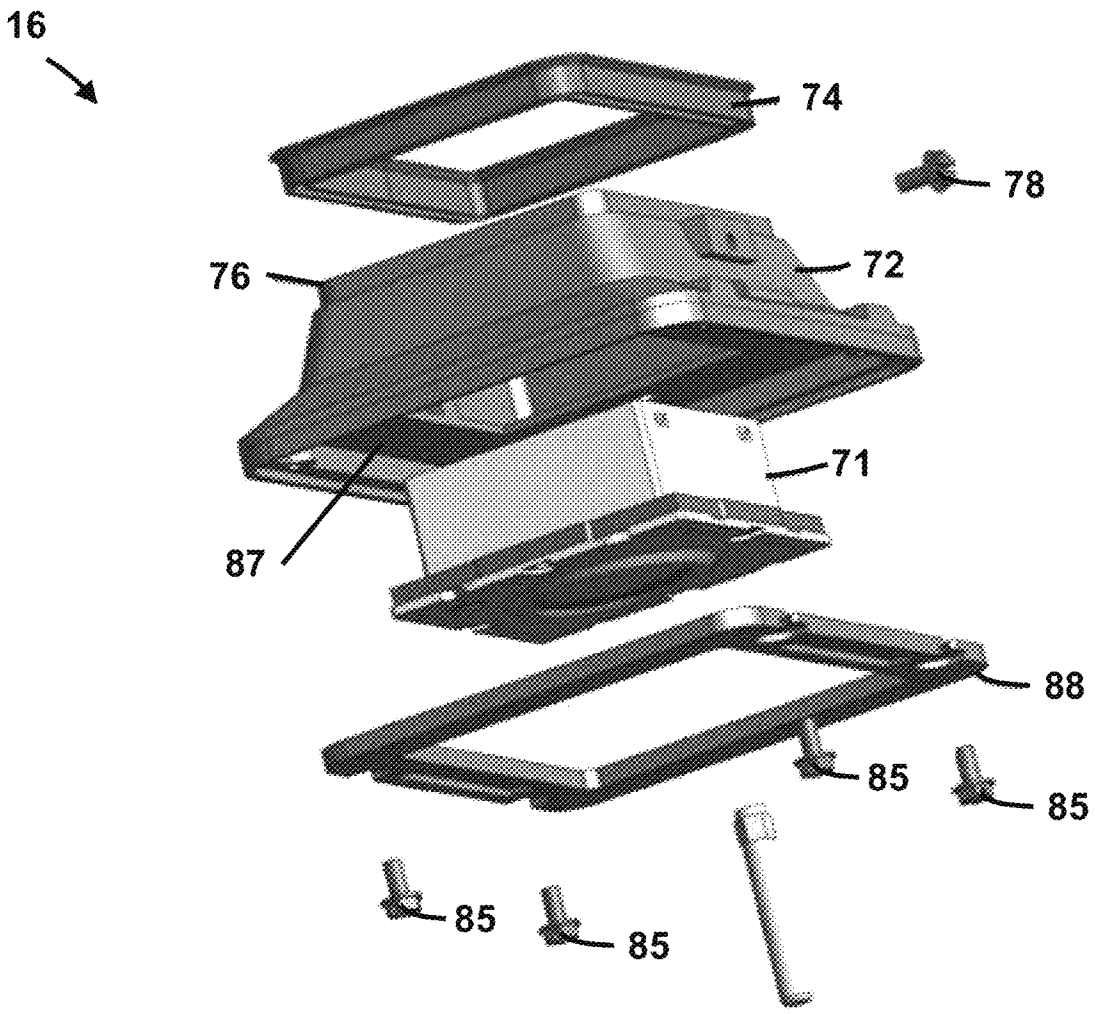
FIGS. 28 and 29 show views of an embodiment of an accessory module according to the present invention.
Figure 29:
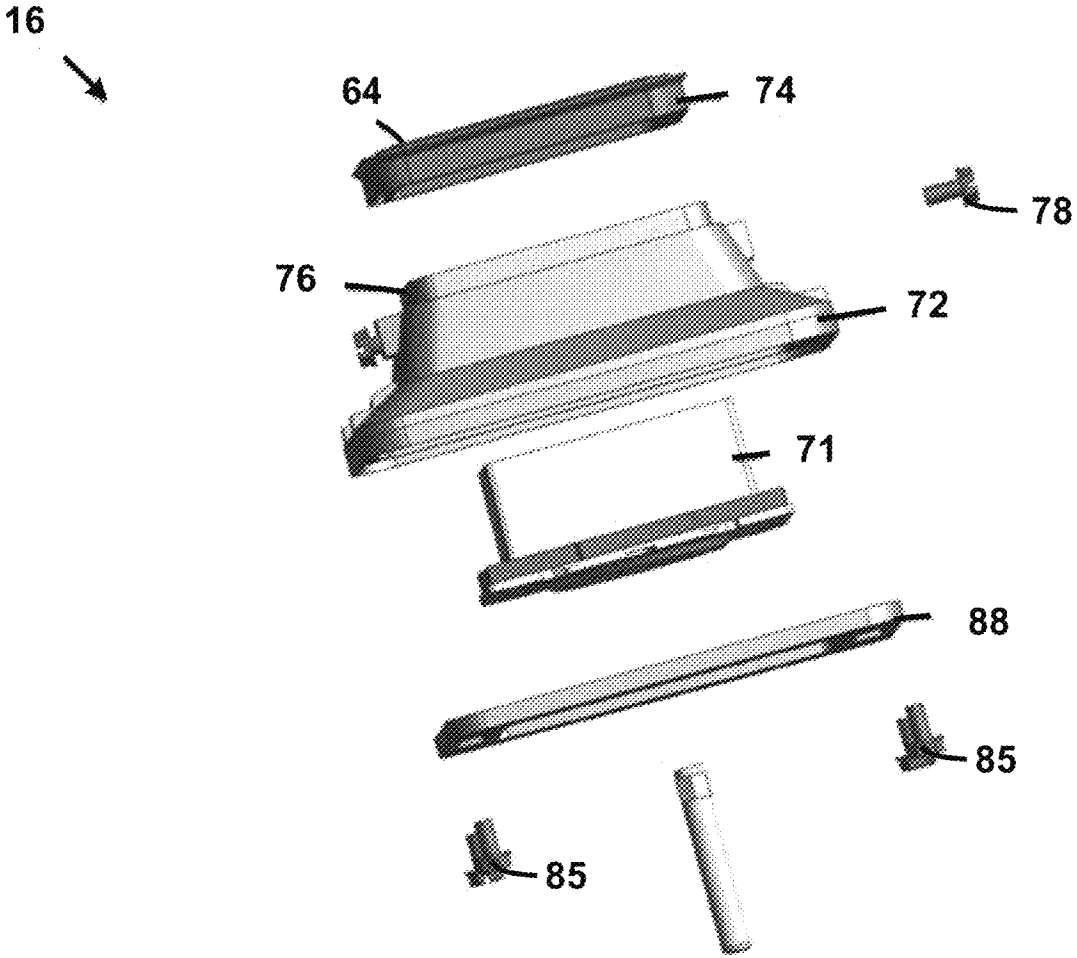

In embodiments, luminaires 10 many include one or more accessory modules 16. The accessory modules 16 may be attached to the driver channel 12 similarly to the light modules 14, and may include similar components. Accessory modules 16 may include, but are not limited to, sensors, BLE modules, battery test switches, etc. FIGS. 28 and 29 show exploded views of an embodiment of an accessory module 16 including a sensor 71. As shown, accessory modules 16 may include an enclosure 72. Enclosure 72 may include any of the features of a heat sink 50 as described above. For example as shown, enclosure 72 defines a rib 76 receiving a gasket 74 to seal against the sealing ledge 26 of the driver channel 12. Further, as shown, the accessory module 16 may include a retainer ring 88, similar to the lens retainer ring 70, which is used to clamp the sensor 71, of other accessory components, to the enclosure 72. The accessory module 16 may include a gasket 87 to seal against the central wall 77 of the enclosure to prevent the ingress of water through the enclosure and into the interior of the driver channel 12.

Assembly

Figure 30:
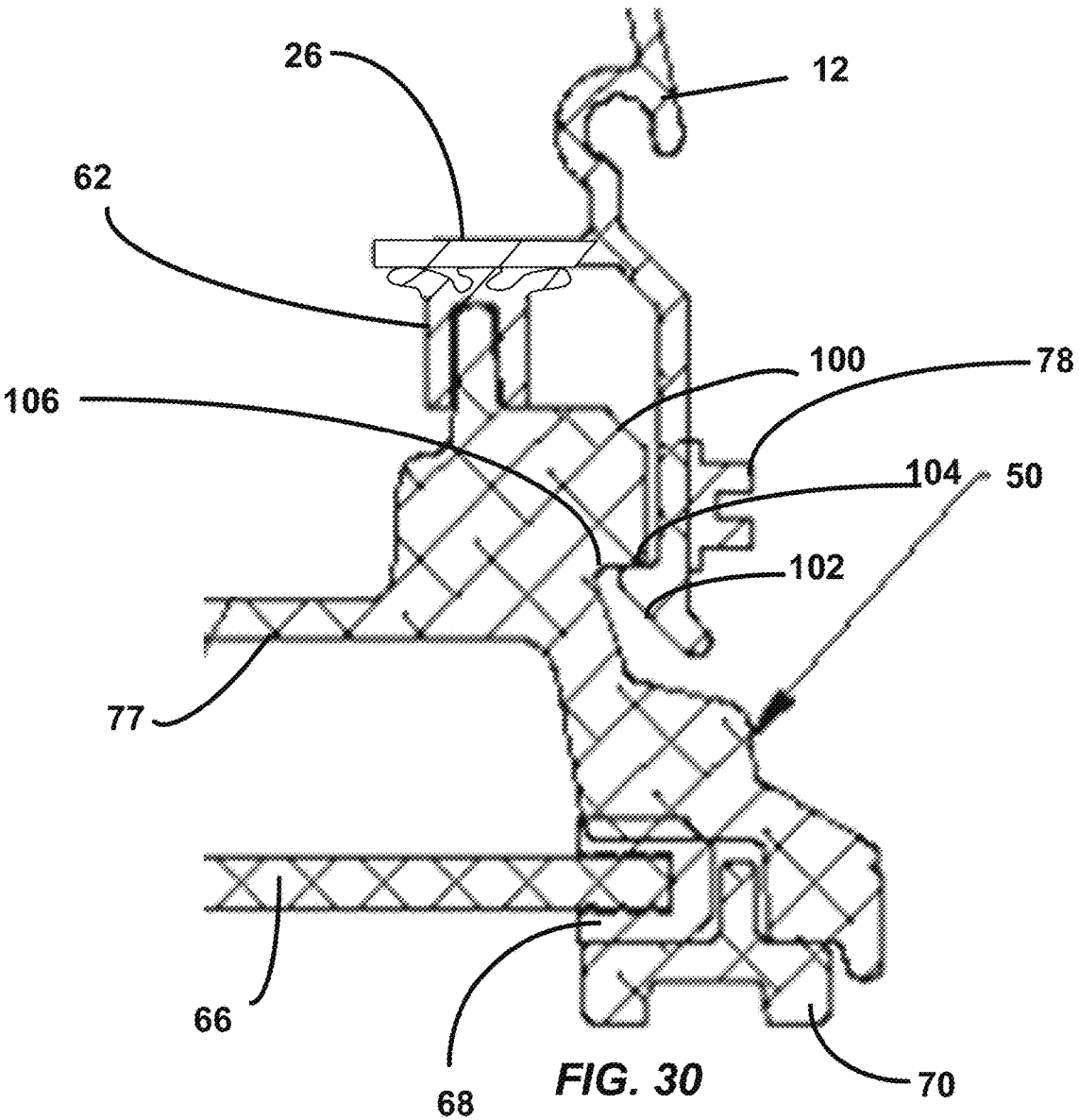
FIG. 30 shows a cross-sectional view of an embodiment of a linear luminaire according to the present invention.

To assemble a luminaire 10, a driver channel 12 having the desired length and opening(s) of the size and number for the intended modules may be selected. For example, for a single light module luminaire a two foot driver channel 12 with a single opening 44 may be selected. As shown in FIG. 11, a light module 14 may be positioned over the opening 44 of the driver channel 12 with the gasket 62 against the seal ledge 26. The heat sink 50 and the distal ends of the lateral sides of the driver channel 12 can include ramped surfaces 100, 102 (respectively) that engage each other to cause the lateral sides of the driver channel 12 to flex outwardly and permit entry of the light module 14 in the driver channel 12, as shown in FIG. 30. Once in place, an inwardly projecting ledge 104 in the driver channel 12 may abut an outwardly projecting ledge 106 of the heat sink 50 to at least partially retain the light module 14 within the driver channel 12. During this process, the gasket 62 abuts and compresses against the sealing ledge 26 within the driver channel 12. The gasket 62 may include fingers 64 which render the gasket 62 universal and able to be used in most luminaire embodiments despite geometrical and tolerance differences. More specifically, the fingers 64 permit the gasket 62 to assume different thicknesses when compressed. Screws 78, bolts, or other fasteners are then inserted through holes 84 in the lateral walls of the driver channel 12 and into receiving holes 83 in the heat sink 50 to retain the light module 14 tightly against the sealing ledge 26 and within the driver channel 12, as shown in FIG. 30. As shown in FIG. 30 and noted above, the screws 78 do not extend into the interior of the driver channel 12 or heat sink 50, and therefore do not form a potential path for water ingress. Accessory modules 16 may be installed in the driver channel 12 in this same way.

As noted above, the ends caps 28 may be attached to the driver channel 12 with fasteners 81 inserted into the mounting rails 20 and 22. The ends caps 28 and modules 14 and 16 may be attached to the driver channel 12 in any order. In embodiments, the end caps 28 and modules 14 and 16 may be attached to the driver channel 12 at the final installation site, and/or may be attached prior to the final installation site. Before or after attaching a light module 14 or an accessory module 16 to the driver channel 12 the modules may be electrically coupled to electronic components within the driver channel 12. The end caps 28 and light module 14 collectively enclose the driver channel 12 to create an airtight, waterproof enclosure for the electronics housed therein.

In embodiments, the driver channel 12 may be cut to a custom length either at the final installation site or beforehand. Additionally, the openings 44 may be cut either at the final installation site or beforehand. More specifically, the driver channel 12 is cut to the necessary length to accommodate the number of light modules 14 and accessory modules 16. Openings 44 (of the desired size and at the appropriate location) are cut into sealing ledge 26. It should be noted that, in this way, a universal driver channel 12 can be manufactured and subsequently customized depending on the desired configuration of the luminaire 10.

Installation

As noted above the driver channel 12 or fully or partially assembly luminaire 10 may be mounted to a structure at an installation site. In embodiments, mounting accessories for installing the luminaire 10 may engage either or both of the upper and lower mounting rails 20, 22 along the length of the driver channel 12. In embodiments, mounting brackets 32 snap fit into the upper mounting rails 20. Screws, bolts, or other fasteners may optionally be used to secure the mounting brackets 32 in place along the length of the driver channel 12. Any number of mounting brackets 32 may be used to install the luminaire 10 as desired (e.g., suspended, flush or surface-mounted, etc.). Moreover, mounting brackets 32 with different geometries may also be used depending on the desired installation and orientation of the luminaire 10. Moreover, mounting brackets 32 need not be used in all installations.

In embodiments, the mounting brackets 32 are first mounted to a building surface and the driver channel 12 is subsequently attached to the already mounted mounting bracket 32, for example by snap-fit. Light modules 14 and/or accessory modules 16 may be attached to the driver channel 12 before or after the driver channel 12 is attached to the mounting bracket 32.

Multiple Modules

In embodiments a luminaire may have any combination of modules, and include one or more light modules 14 and/or one or more accessory modules 16. The geometry (size, shape, etc.) of the openings 44 may be different depending in part on the geometry of the module coupled to the driver channel 12 adjacent to the opening 44. As shown in FIGS. 1-6, a luminaire may include a single light module 14 received adjacent a single opening 44 of a driver channel 12 with the gasket 62 against the sealing ledge 26 surrounding the single opening 44. As shown in FIGS. 15-19 a linear luminaire may include one light module 14 and one accessory module 16. As noted above, the driver channel 12 may define an opening for each module 14 and 16, for example as shown in FIGS. 20 and 21, a driver channel 12 of the luminaire of FIG. 15 includes a larger opening 44 corresponding to the light module 14 and a smaller opening 44 corresponding to the accessory module 16. As shown, the sealing ledge 26 between the module is sized to have a width to accommodate the gaskets 62 and 74 of both the light module 14 and the accessory module 16.

Figure 22:
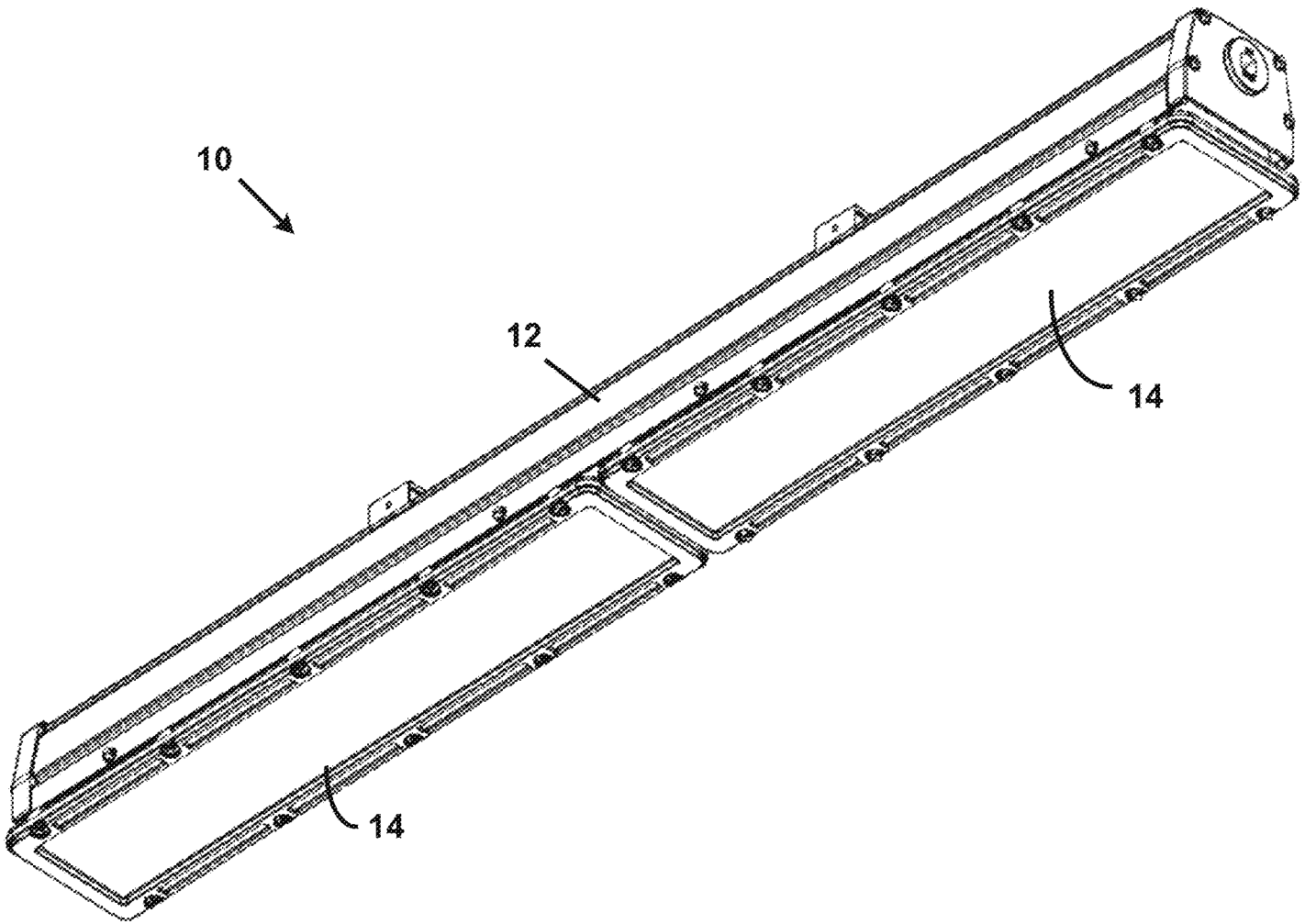
FIG. 22 shows an embodiment of a linear luminaire including two light modules according to the present invention.
Figure 23:
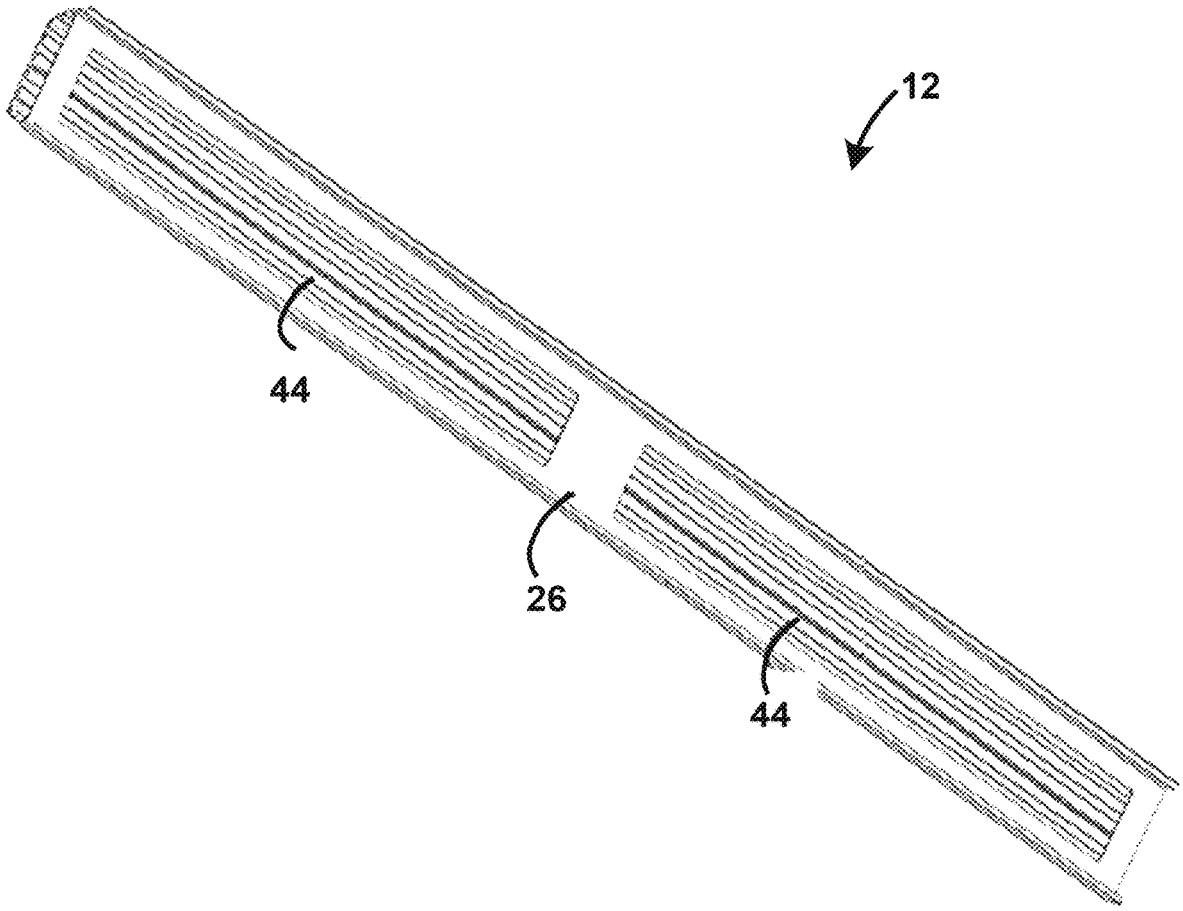
FIG. 23 shows an embodiment of a driver channel with two openings according to the present invention.
Figure 24:
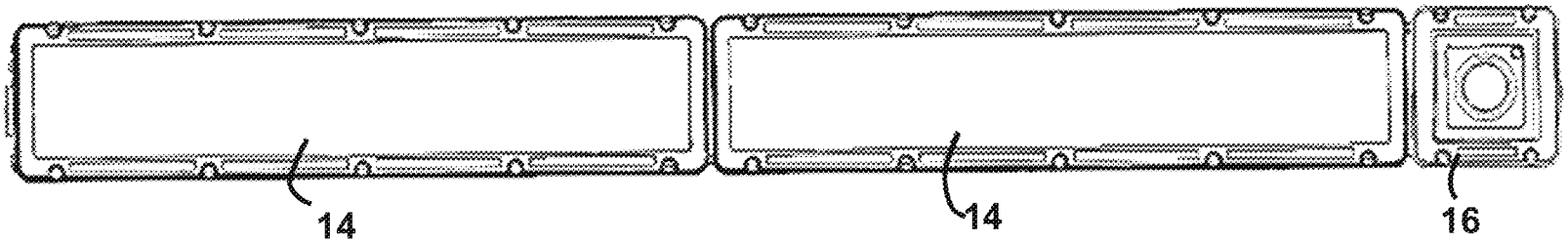
FIG. 24 shows an embodiment of a linear luminaire including two light modules and an accessory module according to the present invention.
Figure 25:
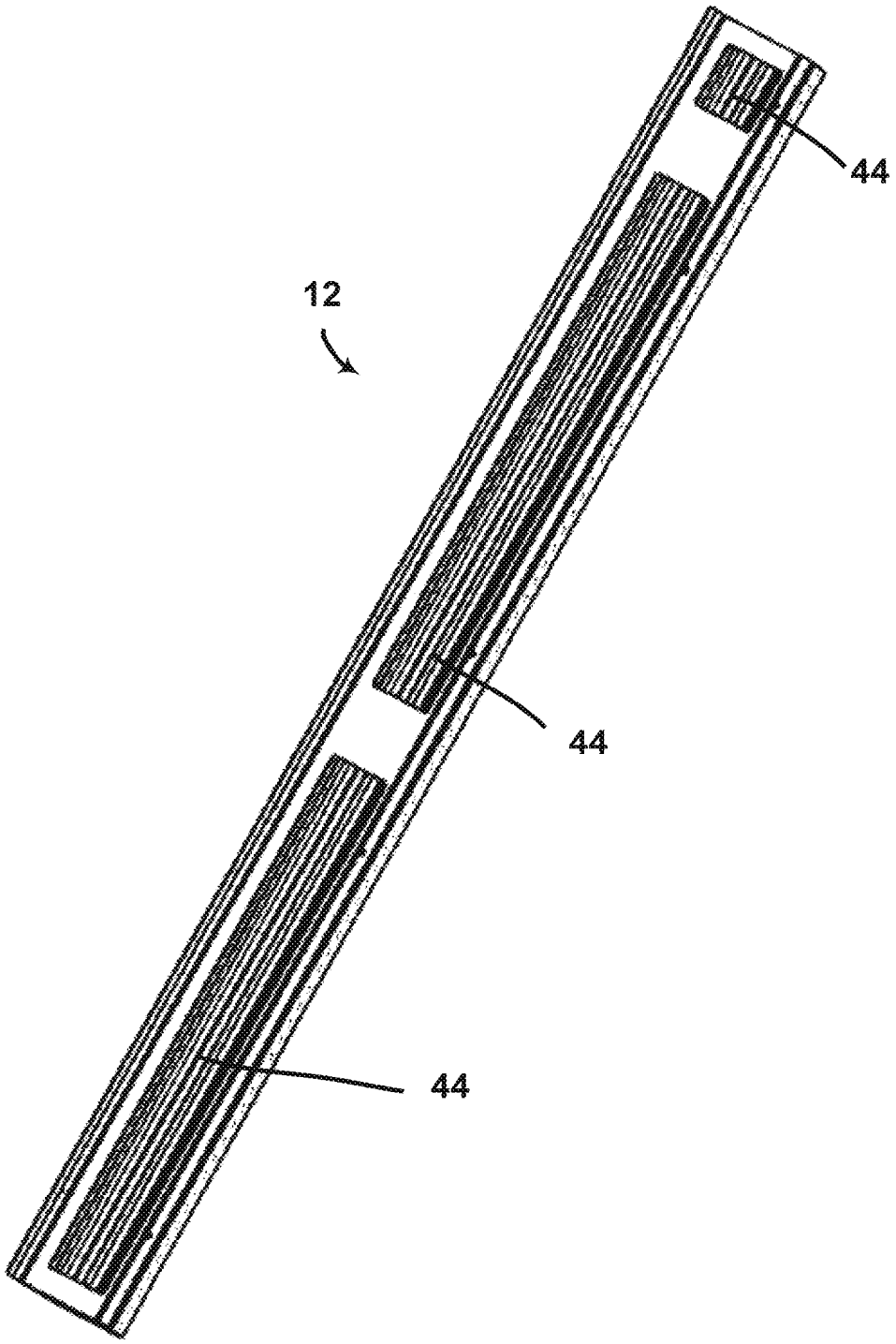
FIG. 25 shows views of an embodiment of a driver channel with three openings according to the present invention.
Figure 26:
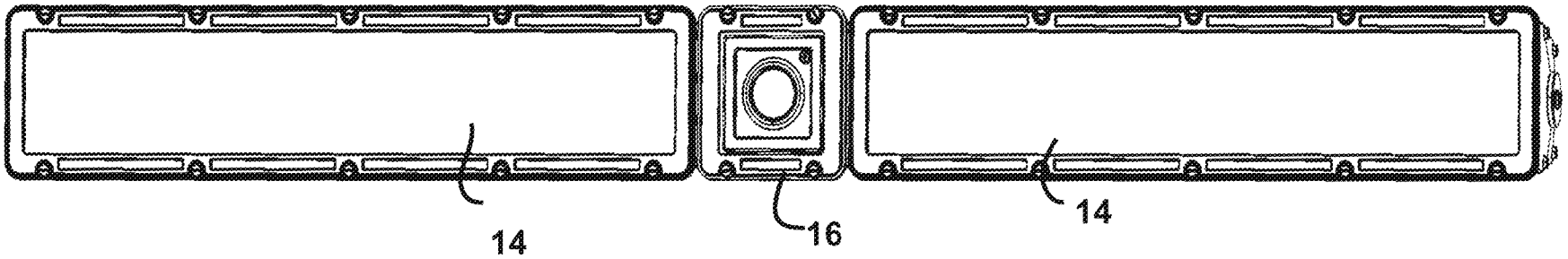
FIG. 26 shows an embodiment of a linear luminaire including two light modules and an accessory module according to the present invention.
Figure 27:
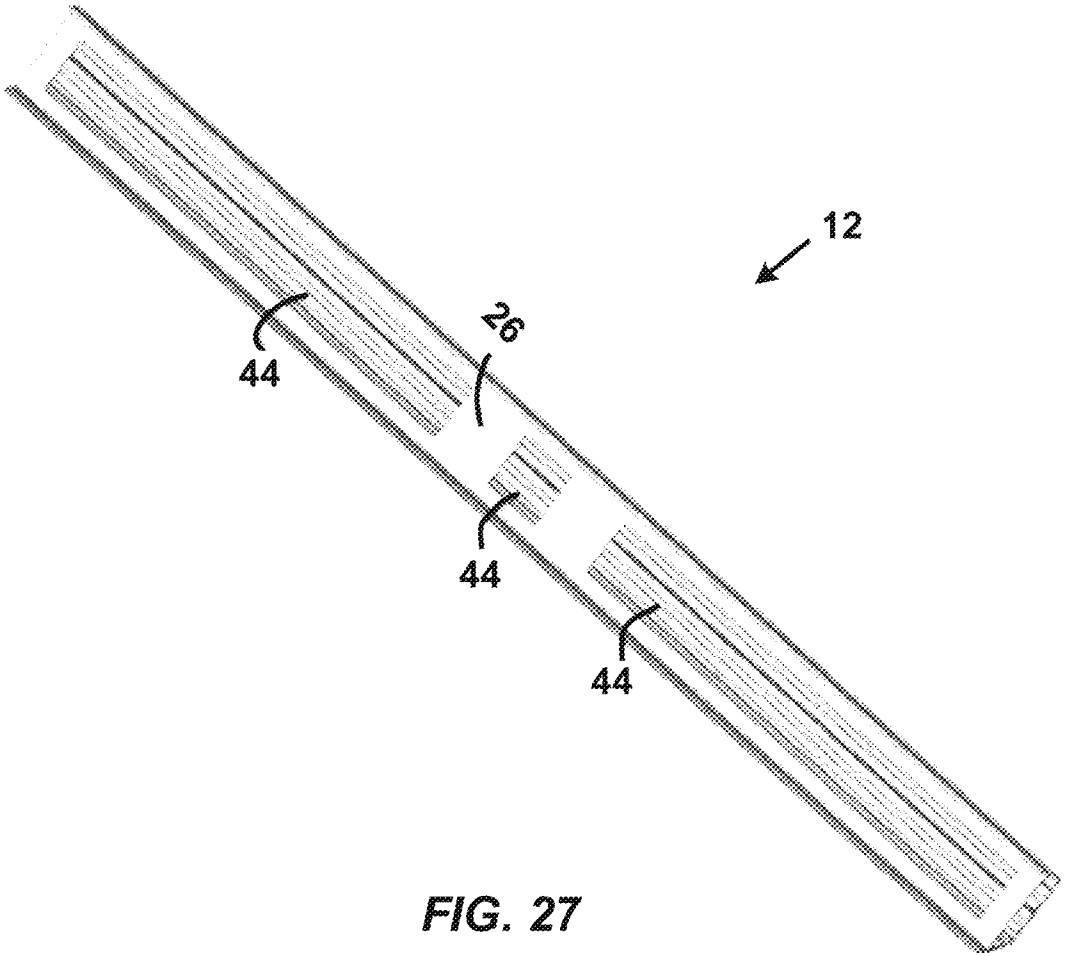
FIG. 27 shows views of an embodiment of a driver channel with three openings according to the present invention.

As shown in FIG. 22 a linear luminaire may include two light modules 14. As shown in FIG. 23 the corresponding driver channel 12 may define two identical openings 44 with corresponding portions of the sealing ledge 26 surrounding the openings 44 for each of the two light modules 14. As shown in FIGS. 24 and 26 a linear luminaire may include two light modules 14 and one accessory module 16. The modules may be arranged in any order/arrangement, for example the accessory module 16 on an end as shown in FIG. 24, or the accessory module 16 in the middle of two light modules 14 as shown in FIG. 26. FIGS. 25 and 27 show the driver channels 12 corresponding to the luminaires of FIGS. 24 and 26, respectively.

The luminaire design disclosed herein results in the light modules 14 and accessory modules 16 being entirely separate from each other such that servicing and removal of one does not impact the others provided in the luminaire 10. Note that while the luminaire 10 may be particularly suited for high bay applications, it certainly is not limited to such applications. Rather, the luminaire 10 may be used in other applications and aspects of its design may be incorporated into other types of fixtures.

Luminaires 10 according to some embodiments are compliant with one or more standards such that the luminaire 10 is suitable for use in harsh industrial applications including, but not limited to, food preparation, petroleum refineries, ethanol facilities, chemical plants, power plants, textile mills, water treatment and wastewater treatment facilities. As one example, the luminaire may be compliant with standards for food preparation applications, such as the National Sanitation Foundation (NSF)/American National Standards Institute (ANSI) standard NSF/ANSI 2-2015 titled "Food Equipment." As another example, the luminaire 10 may be compliant with standards for other harsh or hazardous locations, such as the UL standard UL-844 titled "UL Standard for Safety Luminaires for use in Hazardous (Classified) Locations." In various cases, the luminaire 10 may also be compliant with the UL standard UL-1598 titled "UL Standard for Safety Luminaires."

Terms such as "upper, "lower,", "top,", and "bottom" refer only to the orientation of the examples in the figures. Luminaires 10 embodying the invention may be used in other orientations, for example an orientation in which a "top" or "upper" surface as shown in the figures faces downward in practice.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

What is claimed is:

1. A linear luminaire comprising:

a driver channel defining a top side, a bottom side, two lateral sides, and two open longitudinal ends opening into a hollow interior, wherein the bottom side defines a first opening surrounded by a sealing ledge;

a light module positioned adjacent the first opening in the bottom side of the driver channel and coupled to the driver channel so that a seal is formed between the light module and the sealing ledge;

a light driver electrically coupled to the light module; and two end caps each coupled to the driver channel to seal the two open longitudinal ends, wherein the hollow interior of the driver channel is sealed by the coupling of the light module and the two end caps, wherein the driver channel is formed monolithically, wherein the driver channel is formed by extrusion, wherein an interior surface of the top side of the driver channel comprises mounting rails, and wherein the light driver is mounted to the mounting rails without fasteners extending through the driver channel outside of the hollow interior.

2. The linear luminaire of claim 1, further comprises a mounting bracket, wherein the driver channel comprises mounting rails on an exterior surface, wherein the mounting bracket is coupled to the mounting rails via snap fit, and wherein the coupling of the mounting bracket to the driver channel does not comprise fasteners extending into the hollow interior.

3. The linear luminaire of claim 2, wherein the mounting rails on the exterior surface extend along an entire length of the driver channel.

4. A method of making the linear luminaire of claim 1, comprising:

extruding a hollow body defining the top side, the bottom side, and the two lateral sides, cutting the hollow body to a predetermined length to define the driver channel defining the two open longitudinal ends opening into the hollow interior;

removing a portion of the bottom side to define the first opening surrounded by the sealing ledge;

positioning the light module adjacent the first opening and coupling the light module to the driver channel so that a seal is formed between the light module and the sealing ledge;

coupling the light driver to the driver channel and electrically coupling the light driver to the light module; and coupling the two end caps to the driver channel to seal the two open longitudinal ends.

5. The method of claim 4, wherein extruding the hollow body comprises forming mounting rails on an exterior surface of the hollow body, and wherein the method further comprises coupling a mounting bracket to the mounting rails without using fasteners extending into the hollow interior.

6. The method of claim 4, further comprising:

removing a second portion of the bottom side to define a second opening surrounded by the sealing ledge;

positioning a second light module adjacent the second opening and coupling the second light module to the driver channel so that a second seal is formed between the second light module and the sealing ledge.

7. A linear luminaire comprising:

a driver channel defining a top side, a bottom side, two lateral sides, and two open longitudinal ends opening into a hollow interior, wherein the bottom side defines a first opening surrounded by a sealing ledge;

a light module positioned adjacent the first opening in the bottom side of the driver channel and coupled to the driver channel so that a seal is formed between the light module and the sealing ledge;

a light driver electrically coupled to the light module;

two end caps each coupled to the driver channel to seal the two open longitudinal ends; and a mounting bracket, wherein the driver channel comprises mounting rails on an exterior surface, wherein the mounting bracket is coupled to the mounting rails via snap fit, and wherein the coupling of the mounting bracket to the driver channel does not comprise fasteners extending into the hollow interior, wherein the hollow interior of the driver channel is sealed by the coupling of the light module and the two end caps wherein the driver channel is formed monolithically, wherein the mounting rails on the exterior surface extend along an entire length of the driver channel, and wherein the two end caps are coupled to the driver channel with fasteners extending through the end caps and longitudinally into channels defined by the mounting rails on the exterior surface.

8. The linear luminaire of claim 7, wherein at least one of the end caps defines an aperture through which an input power line extends, and wherein the input power line is coupled to the light driver.

9. A linear luminaire comprising:

a driver channel defining a top side, a bottom side, two lateral sides, and two open longitudinal ends opening into a hollow interior, wherein the bottom side defines a first opening surrounded by a sealing ledge;

a light module positioned adjacent the first opening in the bottom side of the driver channel and coupled to the driver channel so that a seal is formed between the light module and the sealing ledge;

a light driver electrically coupled to the light module; and two end caps each coupled to the driver channel to seal the two open longitudinal ends, wherein the hollow interior of the driver channel is sealed by the coupling of the light module and the two end caps, wherein the driver channel is formed monolithically, wherein the driver channel is formed by extrusion, and wherein the light module comprises:

a heat sink defining an upper cavity and a lower cavity separated by a central wall; and a light engine coupled to the central wall in the lower cavity.

10. The linear luminaire of claim 9, wherein the light module further comprises a lens assembly comprising a lens and a lens gasket coupled to the heat sink to seal the lower cavity and wherein the light engine is coupled to the light driver with wiring extending through an aperture in the central wall.

11. The linear luminaire of claim 9, wherein the light module further comprises a gasket coupled to a rib extending around a perimeter of the upper cavity, and wherein the gasket forms the seal between the light module and the sealing ledge.

12. The linear luminaire of claim 11, wherein the gasket comprises a plurality of deformable fingers.

13. The linear luminaire of claim 9, wherein the light module is coupled to the driver channel with a snap fit between the heat sink and the two lateral sides.

14. The linear luminaire of claim 9, wherein the light module is coupled to the driver channel with a fastener extending through at least one of the two lateral sides into the heat sink, and wherein the fastener does not extend into the hollow interior of the driver channel.

15. The linear luminaire of claim 9, wherein the bottom side defines a second opening surrounded by a sealing ledge; and wherein the linear luminaire further comprises as second light module identical to the light module, wherein the second light module is positioned adjacent the second opening in the bottom side of the driver channel and coupled to the driver channel so that a second seal is formed between the second light module and the sealing ledge.

16. A linear luminaire comprising:

a driver channel defining a top side, a bottom side, two lateral sides, and two open longitudinal ends opening into a hollow interior, wherein the bottom side defines a first opening surrounded by a sealing ledge;

a light module positioned adjacent the first opening in the bottom side of the driver channel and coupled to the driver channel so that a seal is formed between the light module and the sealing ledge;

a light driver electrically coupled to the light module; and two end caps each coupled to the driver channel to seal the two open longitudinal ends, wherein the hollow interior of the driver channel is sealed by the coupling of the light module and the two end caps, wherein the bottom side defines a second opening surrounded by the sealing ledge; and wherein the linear luminaire further comprises an accessory module positioned adjacent the second opening in the bottom side of the driver channel and coupled to the driver channel so that a second seal is formed between the accessory module and the sealing ledge.

17. The linear luminaire of claim 16, wherein the accessory module comprises:

a heat sink defining an upper cavity and a lower cavity separated by a central wall;

a sensor provided in the lower cavity; and a gasket coupled to a rib extending around a perimeter of the upper cavity, wherein the gasket forms the second seal between the accessory module and the sealing ledge.

* * * * *